US011258213B2

(12) United States Patent
Smith et al.

(10) Patent No.: US 11,258,213 B2
(45) Date of Patent: Feb. 22, 2022

(54) COUPLING MECHANISM AND CONNECTOR WITH THE SAME

(71) Applicant: Amphenol Corporation, Wallingford, CT (US)

(72) Inventors: James T. Smith, Portland, OR (US); Michael A. Hoyack, Newtown, CT (US); Owen R. Barthelmes, Putnam Valley, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 17/129,325

(22) Filed: Dec. 21, 2020

(65) Prior Publication Data

US 2021/0265789 A1 Aug. 26, 2021

Related U.S. Application Data

(63) Continuation-in-part of application No. 16/871,114, filed on May 11, 2020.

(Continued)

(51) Int. Cl.

| | |
|---|---|
| ***H01R 24/40*** | (2011.01) |
| ***H01R 13/506*** | (2006.01) |
| ***H01R 13/6581*** | (2011.01) |
| ***H01R 13/627*** | (2006.01) |
| ***H01R 13/52*** | (2006.01) |

(Continued)

(52) U.S. Cl.

CPC ..... *H01R 24/40* (2013.01); *H01R 12/70* (2013.01); *H01R 13/506* (2013.01); *H01R 13/5205* (2013.01); *H01R 13/6271* (2013.01); *H01R 13/6581* (2013.01); *H01R 2103/00* (2013.01)

(58) Field of Classification Search

None

See application file for complete search history.

(56) References Cited

U.S. PATENT DOCUMENTS

| | | | |
|---|---|---|---|
| 4,072,386 | A | 2/1978 | Wallo |
| 4,533,194 | A | 8/1985 | Boichut |

(Continued)

FOREIGN PATENT DOCUMENTS

| | | | |
|---|---|---|---|
| FR | 2990069 | A1 | 11/2013 |
| WO | WO 2010/114068 | A1 | 10/2010 |
| WO | WO 2016/097696 | A1 | 12/2015 |

OTHER PUBLICATIONS

MCX Connector Series, https://www.amphenolrf.com/connectors/mcx.html, copyright 2019.

(Continued)

*Primary Examiner* — Oscar C Jimenez

(74) *Attorney, Agent, or Firm* — Blank Rome LLP

(57) ABSTRACT

A connector that has a conductive shell that supports at least one signal contact therein. The shell comprises a front end for mating with a mating connector and a back end opposite the front end for connecting to a power or data transmission cable. A coupling member is configured to engage the conductive shell and engage a corresponding component associated with the mating connector to mechanically couple the connector and the mating connector together. A plurality of ground connections are provided at the front end of the conductive shell and the front section of the coupling member for grounding.

23 Claims, 25 Drawing Sheets

Related U.S. Application Data

(60) Provisional application No. 62/979,878, filed on Feb. 21, 2020, provisional application No. 62/979,259, filed on Feb. 20, 2020.

(51) Int. Cl.
*H01R 12/70* (2011.01)
*H01R 103/00* (2006.01)

(56) References Cited

U.S. PATENT DOCUMENTS

| | | | | |
|---|---|---|---|---|
| 4,598,961 | A | 7/1986 | Cohen | |
| 4,666,231 | A | 5/1987 | Sheesley | |
| 4,941,846 | A * | 7/1990 | Guimond | H01R 24/542 439/180 |
| 5,176,533 | A | 1/1993 | Sakurai | |
| 5,217,391 | A | 6/1993 | Fisher, Jr. | |
| 5,547,400 | A | 8/1996 | Wright | |
| 5,562,506 | A | 10/1996 | Wright | |
| 5,595,499 | A | 1/1997 | Zander | |
| 6,663,434 | B1 | 12/2003 | Wu | |
| 6,692,286 | B1 | 2/2004 | De Cet | |
| 6,695,644 | B2 | 2/2004 | Zhao | |
| 7,086,867 | B2 | 8/2006 | Nakagawa | |
| 7,758,370 | B1 | 7/2010 | Flaherty | |
| 7,914,344 | B2 | 3/2011 | Tin | |
| 7,972,158 | B2 * | 7/2011 | Wild | H01R 13/6277 439/257 |
| 8,087,954 | B2 | 1/2012 | Fuchs | |
| 8,162,672 | B2 | 4/2012 | Huang | |
| 8,388,377 | B2 * | 3/2013 | Zraik | H01R 13/6395 439/584 |
| 8,801,459 | B2 | 8/2014 | Mrowka | |
| 8,961,224 | B2 | 2/2015 | Grek | |
| 9,384,872 | B2 | 7/2016 | Wild | |
| 9,559,458 | B2 * | 1/2017 | Zhang | H01R 13/623 |
| 9,633,765 | B2 | 4/2017 | Natoli | |
| 9,735,531 | B2 | 8/2017 | Zhu | |
| 10,741,972 | B2 | 8/2020 | Iwamoto | |
| 2003/0139081 | A1 | 7/2003 | Hall | |
| 2009/0215315 | A1 | 8/2009 | Cheng | |
| 2010/0297875 | A1 | 11/2010 | Purdy | |
| 2011/0143603 | A1 | 6/2011 | Huang | |
| 2011/0165789 | A1 | 7/2011 | Sykes | |
| 2017/0054258 | A1 | 2/2017 | Little | |
| 2019/0020149 | A1 * | 1/2019 | Wu | H01R 13/622 |
| 2021/0143564 | A1 | 5/2021 | Smith | |

OTHER PUBLICATIONS

SSMB Connector Series, https://www.amphenolrf.com/connectors/ssmb.html, copyrigh 2019.

European Search Report issued in EP Application No. 18207632.3 dated Jul. 10, 2019.

* cited by examiner

RETURN LOSS

| FREQUENCY RANGE | RETURN LOSS |
|---|---|
| DC-1.8 GHz: | -32 dB |
| 1.8-3 GHz: | -30 dB |
| 3-6 GHz: | -25 dB |
| 6-9 GHz: | -20dB |
| 9-18 GHz: | -15 dB |

RF LEAKAGE

| FREQUENCY RANGE | RETURN LOSS |
|---|---|
| DC-1.8 GHz: | -100 dB |
| 1.8-3 GHz: | -90 dB |
| 3-6 GHz: | -80 dB |

COUPLING MECHANISM AND CONNECTOR WITH THE SAME

RELATED APPLICATIONS

This application claims priority to U.S. provisional application No. 62/979,878, filed Feb. 21, 2020 and U.S. provisional application No. 62/979,259, filed Feb. 20, 2020, and is a continuation-in-part of U.S. application Ser. No. 16/871,114, filed on May 11, 2020, each of which is entitled High Frequency Electrical Connector, and the subject matter of each of which is herein incorporated by reference.

BACKGROUND

CATV networks are used to deliver high speed data (e.g. internet and entertainment) to households and businesses. The need for increased data speeds and bandwidth is driving the development and deployment of enhanced or upgraded networks. Current networks are defined by DOCSIS (Data Over Cable Service Interface Specification). Many of the current networks use a version of DOCSIS entitled DOCSIS 3.1, which has a maximum frequency of 1.2 GHz. Next generation networks may use DOCSIS 4.0, which will include "ESD" (Extended Spectrum DOCSIS) and increase the maximum frequency to 1.8 GHz. These systems are expected to deploy soon and will require upgrades to the entire "plant" (wired network) to operate to the higher frequencies, e.g., the maximum frequencies of DOCSIS 3.1 and 4.0.

There is an increased need to prevent RF leakage and RF ingress for all enclosures and transmission lines in CATV networks, including RF connectors and cables, to improve RF performance. This need is increasing because, as more RF spectrum is licensed for commercial use, there is increased opportunity for crosstalk between systems operating in the same spectrum. For optimal RF performance, the connector interfaces and cable transmission lines need to prevent ingress of these wireless signals into wired broadband systems.

The legacy Type F connectors for CATV typically do not perform well at higher frequencies. There is also a well-known robustness and reliability concern with Type F connectors. This is particularly a concern if an installer fails to properly tighten the connector to its mating component, which allows considerable RF leakage resulting in a degraded RF performance. The legacy type F connectors commonly fail CATV networks due to inconsistent and unreliable sealing in outdoor applications.

SUMMARY

The present disclosure provides a connector that comprises a conductive shell supporting at least one signal contact therein. The shell comprises a front end for mating with a mating connector and a back end opposite the front end for connecting to a power or data transmission cable. A coupling member is configured to engage the conductive shell and also engage a corresponding component associated with the mating connector to mechanically couple the connector to the mating connector. A plurality of ground connections are provided at the front end of the conductive shell and the front section of the coupling member that are configured to connect the mating connector with the connector and the cable.

In certain examples, the coupling member is disposed on the conductive shell; the coupling member is rotatably coupled to the conductive shell; the coupling member is a sleeve that includes a front section configured to engage the corresponding component associated with the mating connector and a back section configured to engage the back end of the conductive shell; the connector further comprises a retaining member disposed on the coupling sleeve, the retaining member being slidable with respect to the coupling member between unlocked and locked positions; the retaining member comprises a ring body disposed on the coupling sleeve; and/or the ring body includes an end portion that extends beyond the back section of the coupling member.

In other examples, the front section of the coupling member includes inner threads; the plurality of ground connections define a plurality of grounding paths through the connector to electrically engage the mating connector with the connector and the cable; the coupling member is a spring clip that engages an outer annular groove of the conductive shell; the conductive shell includes a dielectric insert that supports the at least one signal contact; and/or the connector is an electrical connector.

The present disclosure may also provide a connector that comprises a conductive shell supporting at least one signal contact therein. The shell comprises a front end for mating with a mating connector and a back end opposite the front end for connecting to a power or data transmission cable. A coupling sleeve is disposed on the conductive shell. The coupling sleeve includes a front section configured to engage a corresponding component associated with the mating connector and a back section configured to engage the conductive shell. A retaining member is disposed on at least a portion of the coupling sleeve that is slidable with respect to the coupling sleeve between unlocked and locked positions.

In some examples, the coupling sleeve comprises an elongated body with an outer gripping surface, the front section of the coupling sleeve includes inner threads, and the back section is configured to cover the back end of the conductive shell; the coupling sleeve includes one or more flexible latches for engaging the conductive shell and one or more flexible protection tines adjacent to the one or more flexible latches; the retaining member comprises a ring body disposed over the one or more flexible protection tines; the ring body is configured to slide axially with respect to the back end of the conductive shell between the unlocked and locked positions; the ring body includes one or more windows that correspond to the one or more flexible protection tines of the back section of the coupling sleeve; the ring body includes an end portion that extends beyond the back section of the coupling sleeve, the end portion includes an end face in a plane generally perpendicular to a longitudinal axis of the coupling sleeve; and/or the ring body includes one or more tabs opposite the end face that are configured to engage corresponding notches on an outer surface of the coupling sleeve.

In other embodiments, the connector further comprises a plurality of ground connections that define a plurality of grounding paths; the plurality of grounding paths are electrically coupled to form a combined ground path within the connector; the plurality of ground paths are electrically coupled to form a combined ground path outside of the connector; and/or the connector is an electrical connector.

The present disclosure may further provide a connector that comprises a conductive shell supporting at least one signal contact therein. The shell comprises a front end for mating with a mating connector and a back end opposite the front end for electrically connecting to a power or data transmission cable. The front end includes a primary ground connection configured to electrically connect the mating connector with the cable. A coupling sleeve is disposed on the conductive shell. The coupling sleeve includes a front section that has inner threads configured to engage a corresponding component associated with the mating connector, and a back section that has one or more flexible snap latches configured to engage the back end of the conductive shell. The front section of the coupling sleeve includes a secondary ground connection configured to electrically connect the mating connector with the cable. A retaining ring is disposed on the back section of the coupling sleeve that is slidable with respect to the coupling sleeve between unlocked and locked positions.

In certain examples, the back section of the coupling sleeve includes one or more flexible protection tines adjacent to the one or more flexible snap latches; each flexible protection tine includes a ramped surface configured to facilitate sliding of the retaining ring to the locked position; the retaining ring includes one or more windows corresponding to the one or more flexible protection tines; and/or the retaining ring includes an end portion that extends past the back section of the coupling sleeve, and the end portion includes an end face in a plane generally perpendicular to a longitudinal axis of the coupling sleeve.

In other examples, the corresponding component of the mating connector is an engagement feature of a support panel or wall in which the mating connector is mounted; the primary and secondary ground connections are separate contact points, at least one of the contact points being on an outer surface of the front end of the conductive shell and another of the contact points being on an inner surface of the front section of the coupling member; the primary and secondary ground connections define a plurality of grounding paths; the plurality of grounding paths combine to form a combined ground path within the electrical connector; the plurality of ground paths combine to form a combined ground path outside of the electrical connector; and/or the connector is an electrical connector.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE DRAWINGS

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

The present disclosure relates to electrical connectors and the assembly thereof that are designed to significantly improve RF performance, such as for high frequency applications. The electrical connectors of the present disclosure provide reliable and consistent RF performance, even at high frequencies, whether used indoors or outdoors. The present disclosure may be, for example, RF connectors and assemblies for CATV broadband applications configured to provide an intuitive user experience suitable for consumer level usage; enable bandwidth expansion for future systems and protocols, including convergence with 5G; and/or achieve high RF ingress protection against current and future wireless bands. The connector technology of the present disclosure is designed to provide consistent performance with headroom for future network enhancements with higher frequency capability, e.g. 6 GHz and beyond, for both indoor and outdoor applications for coax to the home/business. Also, the connectors of the present disclosure are designed to provide robustness, sealing, and reliability when used outdoors. Although in the example embodiments described herein, the connector is an electrical connector, in other embodiments, the connector may be other types of connectors, such as, but not limited to, an optical fiber, power, signal, or hybrid connector, and the like.

Examples disclosed include a connector that comprises a conductive shell that supports at least one contact therein, such as a signal contact. The shell comprises a front end for mating with a mating connector and a back end opposite the front end for electrically connecting to a power or data transmission cable. A coupling member is configured to engage the conductive shell and engage a corresponding component associated with the mating connector to mechanically couple the electrical connector and the mating connector together. A plurality of ground connections are provided at the front end of the conductive shell and the front section of the coupling member. The ground connections are configured to electrically connect the mating connector with the electrical connector and with the cable.

Examples also include a connector that comprises a conductive shell that supports at least one signal contact therein and comprises a front end for mating with a mating connector and a back end opposite the front end for electrically connecting to a power or data transmission cable. A coupling sleeve is disposed on the conductive shell. The coupling sleeve includes a front section configured to engage a corresponding component associated with the mating connector and a back section configured to engage the conductive shell. A retaining member is disposed on the coupling sleeve. The retaining member is configured to slide with respect to the coupling sleeve between unlocked and locked positions.

Figure 1:
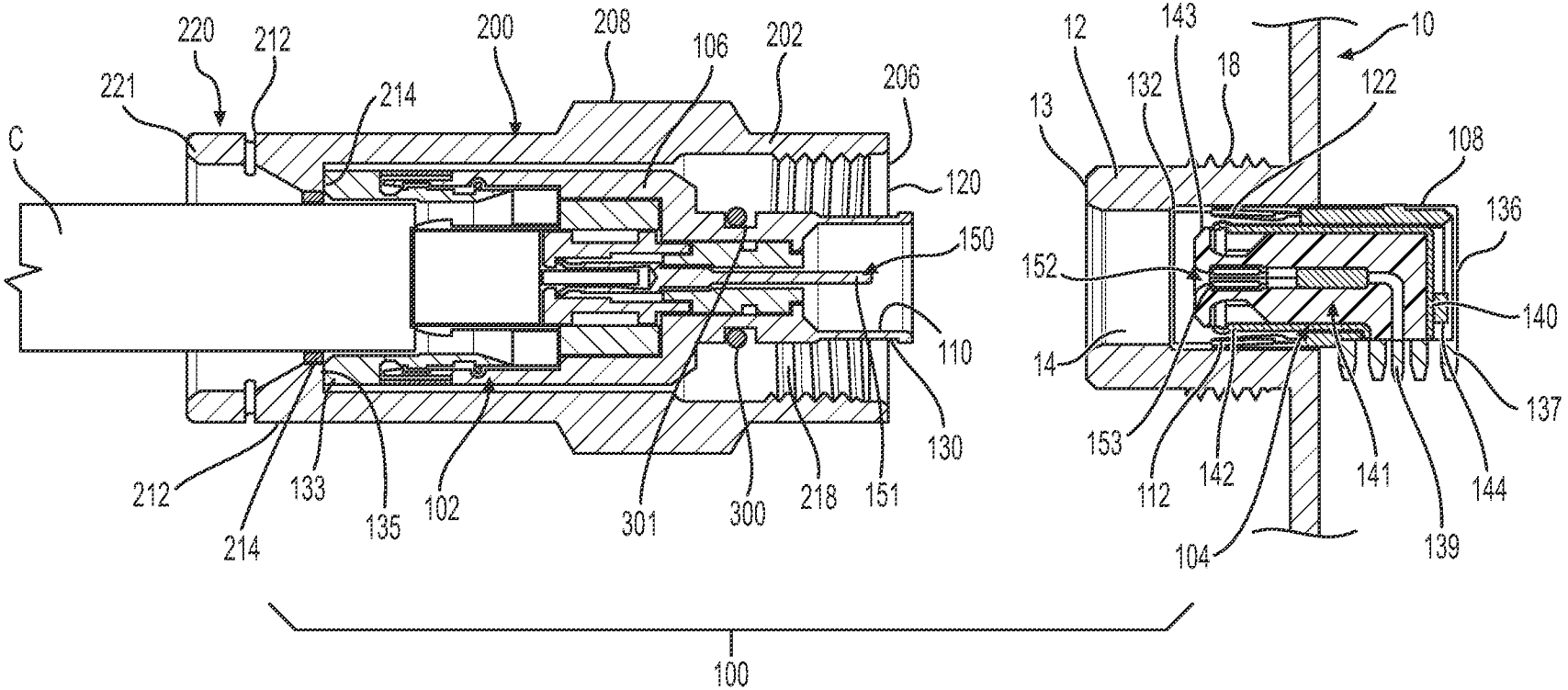
FIG. 1 is an exploded cross-sectional view of electrical connectors and the assembly thereof according to an example of the present disclosure.

Referring to FIG. 1, an electrical connector assembly 100 is illustrated that has electrical connectors or components 102 and 104, according to an example of the present disclosure. The electrical connector 100 is designed to improve RF performance at high frequencies by suppressing RF leakage and ingress at the interface of the assembled connectors 102 and 104, whether used in an indoor or outdoor application. The electrical connector assembly 100 may also incorporate a coupling member 200 configured to provide an additional mechanical engagement between the electrical connectors of the assembly to increase the mechanical strength of the assembly 100, particularly the mechanical strength of the interface the connectors 102 and 104 against cable loading. One or more sealing members, such as sealing member 300, may also be provided with assembly 100. The one or more sealing member are configured to create an environmental seal between the components of the assembly 100, which is useful for outdoor applications.

The connectors or components 102 and 104, may be, for example, a plug and a receptacle, respectively, as seen in FIG. 1. The receptacle 104 may be mounted to a support 10, such as a panel or housing wall. Each of the plug 102 and receptacle 104 has an outer conductive shell 106 and 108, respectively, and at least one signal contact supported therein, such as pin and socket 150 and 152, respectively, that mate with one another. Each outer shell 106 and 108 of connectors 102 and 104 may comprise a front end 130 and 132, respectively, configured to interface with the other mating component.

Figure 2B:
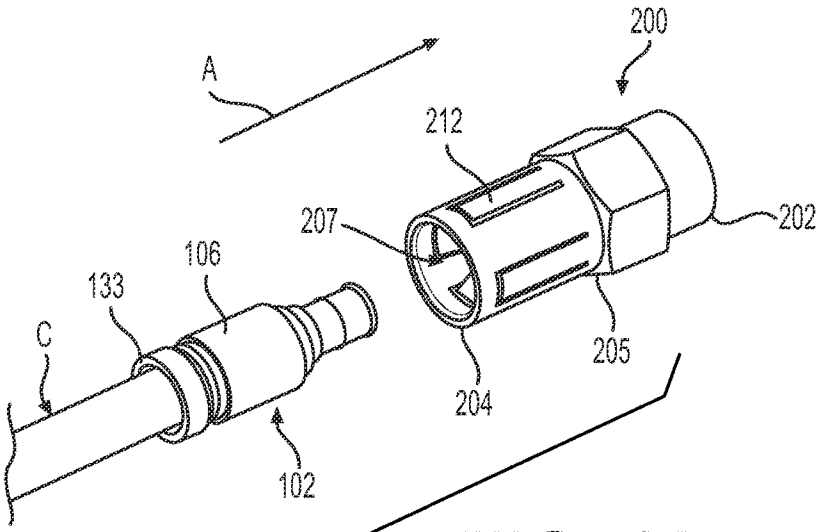
FIGS. 2*a*-2*c* are various perspective views of one of the electrical connectors of the assembly illustrated in FIG. 1, showing an exemplary coupling member of the present disclosure.
Figure 2C:
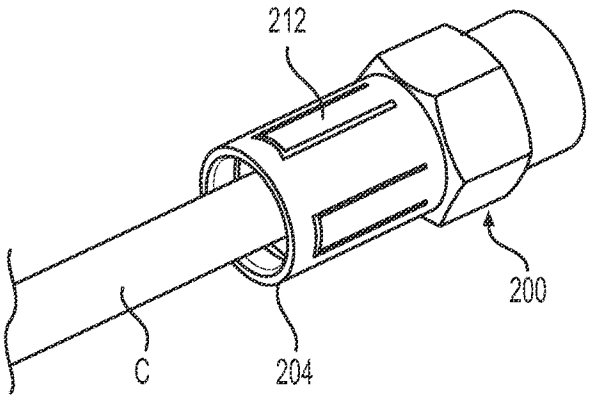
Figure 2A:
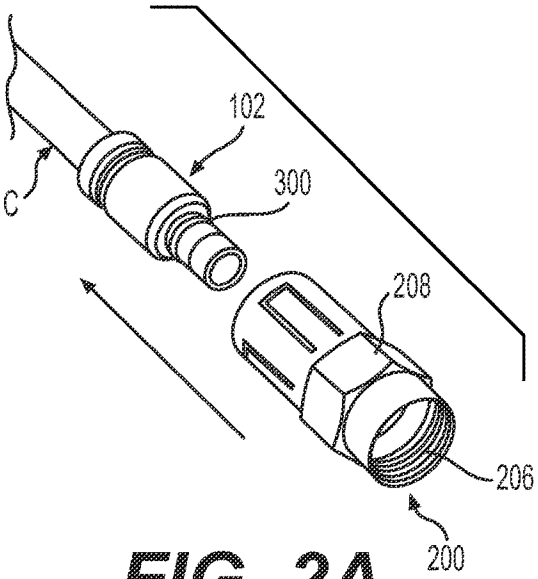

In an example, the back end 133 of the plug's shell 106 is configured to terminate and electrically connect to a cable C, e.g. a coaxial cable, as seen in FIGS. 1 and 2*b*. The cable C has dielectric and a center conductor. The center conductor of the cable C feeds into the center contact of the plug 102. It should be understood that the plug 102 can be configured to accommodate any type of cable, including a power or data transmission cable needed for a particular application, including indoor or outdoor uses of the assembly. And although in the example embodiments described herein, the connector is coupled to a coaxial cable, in other embodiments, the connector may be coupled to other types of cables, such as, but not limited to, optical fiber cable, power cable, signal cable, differential pair cable, a hybrid cable, and the like.

Pin contact 150 of the plug 102 has a contact end 151 for connecting with the corresponding contact end 153 of the socket 152. The back end of pin 150 that is opposite its contact end can be electrically connected to the cable C. As seen in FIG. 1, the pin contact 150 of plug 102 may be supported in a set-back position from the front end 130 of the shell 106. That is, the front end 130 of the plug's shell 106 extends past the contact end of the pin contact 150 such that the pin 150 is set back from the front face of the shell 106, thereby allowing allow for a scoop proof, closed entry mating with the receptacle 104. The back end 136 of the receptacle 104 is configured to electrically connect to a printed circuit board or other component (such as, for example, a filter module or directly to cable to be routed to another location in the device), in a right-hand, straight or other configuration, such as via pins 137 at the back end of the shell 108. The back or tail end of the socket contact 152 opposite its contact end is also electrically connectable to the printed circuit board or other component, such as via one or more pins 139 at the back end of the shell 108. In some examples, the front end 130 of the plug's shell 106 extends beyond the front section 202 of the coupling member 200.

Receptacle 104 may include an inner conductive shell 140. The shell 140 is received inside of the outer conductive shell 108, with a dielectric insert 141 supporting the socket contact 152 therein, as seen in FIG. 1. Socket contact 152 may be supported in a set-back position with respect to the front face of the receptacle's shell 108, similar to the positioning of the pin contact 150 to provide closed entry mating. That is, the receptacle's outer shell 108 may extend past the contact end of socket contact 152 and the end of dielectric insert 141 supporting the socket contact 152. The front end 142 of the receptacle's inner shell 140 can mate with the front end 130 of plug's shell 106 and the back end 144 of the inner shell 140 can electrically engage the printed circuit board or other component. The front end of the inner shell 140 may include one or more spring fingers 143. The fingers 143 generally surround the contact end of socket contact 152. Both back ends of the receptacle's outer and inner shells are configured to engage the printed circuit board or other component, such as by solder or press-fit pins. The space between the inner surface of the receptacle's outer shell 108 and the outer surface of the receptacle's inner shell 140 is a receiving area sized to accommodate the front end 130 of plug's shell 106.

Receptacle 104 can be mounted in the support 10, which may form part of an equipment panel, wall, box, or other component. The support 10 may have a body 12 extending therefrom. The support 10 has an inner bore 14 sized and configured to accept the receptacle 104. At least a portion of the outer surface of the body 12 may have an engagement feature, such as outer threads 18, designed to engage a corresponding engagement feature of the coupling member 200. To assemble the connectors, the front end 130 of plug 102 may be inserted into the front end 132 of receptacle 104 and then pushed onto the receptacle's inner shell 140 such that the pin 150 and the socket 152 are connected and the plug's conductive shell 106 and the receptacle's outer shell 108 are in contact with one another and so that the plug's conductive shells 106 and the receptacle's inner shell 140 are in contact with one another. When the plug and receptacle 102 and 104 are initially mated, the space 218 between the plug's conductive shell 106 and a front section 202 of the coupling member 200 receives the front end of the body 12. As illustrated in FIG. 1, in some examples the receptacle 104 is set back from a front end 13 of the body 12 of the support 10. A benefit of positioning the receptacle 104 in this set-back position is to properly position the center and outer contacts of the receptacle 104 (e.g., the socket 152 and the contacts 112, 122, respectively) from the front end 13 of the body 12 so that when the plug 102 is being mated with the receptacle 104, the plug 102 mates fully and in the correct position with proper contact overlap. Secondarily, the set-back position of the receptacle 104 may allow a front portion of inner bore 14 to be aligned with, integrated with, or both aligned with and integrated with the body 12 so that the inner bore 14 seals properly with the sealing member 300 to reduce or prevent additional leakage paths. In some examples, the sealing member 300 seals to the inner bore 14. In other examples, the sealing member 300 seals to the outer shell 108. In yet other examples, the sealing member 300 may seal to both the outer shell 108 and the inner bore 14.

In the examples of the present disclosure, the plug 102 and receptacle 104 may have a plurality of ground connections, such as primary ground connections 110 and 112, respectively, and secondary ground connections 120 and 122, as seen in FIG. 1, for example. The primary ground connections 110 and 112 define a primary grounding path through the assembly 100 and the secondary ground connections 120 and 122 define a secondary grounding path through the assembly 100. The primary and secondary ground paths can be separate or combined at least partially through the connectors 102 and 104. That is, the plurality of grounding paths can be electrically coupled to form a combined ground path within or outside of the electrical connector.

The primary ground connections 110 and 112 may be any grounding technique, such as grounding through the conductive surfaces or contact points of the shells 106, 108, and 140 of the connectors that are in contact with one another, grounding through added ground contacts isolated and connected to the equipment PCB, or grounding through a traditional single ground, and the like. In one embodiment, each of the primary ground connections 110 and 112 is one or more inner contact points inside of the outer shells 106 and 108. The primary ground connections 110 and 112 according to the present disclosure provide a connection to ensure the RF signal is passed through the connector components, plug 102 and receptacle 104, with minimal signal loss.

The inner contact points of the plug's primary ground connection 110 may be located, for example, on the inner surface of its outer shell 106 near or at the front end 130 thereof and positioned to engage the receptacle's primary ground connection 112, which may be contact points on the outer surface of the receptacle's inner conductive shell 140. The inner contact ground points of receptacle 104 may be located, for example, on one or more of the spring fingers 143 at the front end of the inner shell 140. Alternatively, the inner contact points of the primary ground connections 110 and 112 may be positioned or incorporated into one or more arms, tines, petals, beams, or the like.

The secondary ground connections 120 and 122 are configured to provide additional or dual grounding at the interface of the connector assembly 100. The function of the secondary ground connection 120 and 122 according to the present disclosure is to provide a secondary barrier to significantly reduce the power level of the RF signal that leaks out of, or the RF noise that leaks into, the transmission line between the connectors. The secondary ground connections 120 and 122 reduce the leakage or the power level of the leakage to a point that is less than the sensitively of the system where it is used.

Like the primary ground connection, secondary ground connections 120 and 122 of plug 102 and receptacle 104, respectively, may be any grounding technique, such as grounding through the conductive surfaces of the outer shells 106 or 108 of the connectors, grounding through added ground contacts isolated and connected to the equipment PCB, or grounding through a traditional single ground, and the like. For example, the plug's secondary ground connection 120 may be one or more outer contact points located on the outer surface of the outer shell 106 that connect with one or more inner contact points of the receptacle's ground connection 122. In one aspect, the outer contact points of plug 102 may be positioned in an annular recess of shell 106. The inner contact points of receptacle 104 may be positioned on the inner surface of the shell 108. In an embodiment, the inner contact points of receptacle 104 may be positioned on spring tabs extending inwardly from the shell's inner surface. Alternatively, the outer contact points of the plug 102 and the inner contact points of the receptacle 104 may be positioned on or incorporated into one or more arms, tines, petals, beams, or the like.

In an example of the present disclosure, the coupling member 200 may be configured as a sleeve that can be rotatably coupled to the plug 102. In some examples, the coupling member 200 is rotatably coupled to the plug 102 by snapping the coupling member 200 onto the plug 102, particularly to the plug's conductive shell 106. For example, referring specifically to FIG. 2*b*, the coupling member 200 may be configured to slide over the plug 102 to convert the plug 102 from an indoor-use version to an outdoor-use version. In some examples, the plug 102 is converted from an indoor-use version to an outdoor-use version with the addition of a sealing member 300 on the plug's conductive shell 106. In some examples, a field technician may install the sealing member 300 onto the plug's conductive shell 106 at a groove 301 on the plug's conductive shell 106. The sealing member 300 provides a sealing function between the plug's conductive shell 106 and the inner bore 14 of the body 12 of the support 10 when the plug 102 is coupled to the receptacle 104. In addition, prior to coupling the plug 102 and the receptacle 104, the field technician may also install the coupling member 200 for additional weather proofing and to strengthen the engagement between the plug 102 and the receptacle 104. As described in more detail below, the field technician may slide the coupling member 200 in an axial direction A to rotatably, and in some cases removably, secure the coupling member 200 to the plug 102. Thus, the same plug 102 can be used for indoor applications as well as outdoor applications with the addition of the sealing member 300 and/or the coupling member 200. In practice, a field technician can carry these parts (for example, the plug 102, the sealing member 300, and the coupling member 200) to a job site and decide whether to use the plug 102 by itself (as an indoor-use version) or to use the plug 102, the sealing member 300, and/or the coupling member 200 (as an outdoor-use version) as needed. This eliminates the need for a field technician to carry both indoor-only versions of the plug and outdoor-only versions of the plug, thereby maximizing flexibility and minimizing connector variants in inventory.

The coupling member 200, sometimes referred to herein as a "sleeve 200" may be either plastic, metal, or both or a combination of both plastic and metal. In other examples, the coupling member 200 may be made of other materials depending on the end use of the plug 102.

The coupling sleeve 200 may have an elongated body with front section 202, a back section 204, and a middle section 205 therebetween, as seen in FIGS. 1 and 2*a*-2*c*. The front section 202 has an engagement feature, such as inner threads 206, configured to engage the corresponding engagement feature, such as outer threads 18, of the support 10. The sleeve's middle section 205 has an outer gripping surface 208 to facilitate application of torque to the sleeve 200. The back section 204 of the sleeve 200 is elongated and designed to accept and cover the terminated end of the cable C in some examples. In other examples, the back section 204 does not cover the terminated end of the cable C. One or more flexible latches 212 can be provided at or near the back section 204 of the sleeve 200 for engaging the plug 102. Each latch 212 can have an inner lip 214 extending inside of the sleeve 200. The inner lip 214 may be configured to "snap" over the back end 133 of the plug's shell 106, as best seen in FIG. 1, such that the inner lip 214 contacts a rear-facing surface 135 of the back end 133 of the plug 102 and such that the inner lip 214 acts as a stop to secure (or at least removably secure) the coupling member 200 to the plug 102. Referring specifically to FIG. 2*b*, a field technician may slide the coupling member 200 in an axial direction A to rotatably, and in some cases removably, secure the coupling member 200 to the plug 102. More specifically, the plug 106 passes through a central opening 207 of the back section 204 of the sleeve 200 as the field technician moves the coupling member 200 over the plug. The field technician continues moving the coupling member 200 in the axial direction A and the flexible latches 212 flex as the inner lip 214 or inner lips 214 pass over the plug's conductive shell 106. When the inner lips 214 reach the rear-facing surface 135 of the back end 133 of the plug 102, the flexible latches 212 snap into the position illustrated in FIG. 1 and the inner lip 214 contacts the rear-facing surface 135 of the back end 133 of the plug 102 to secure the coupling member 200 to the plug 102. Thus, in some examples, no tools are required to secure the coupling member 200 to the plug 102.

While the inner lip 214 secures to the rear-facing surface 135 of the back end 133 of the plug 102 in the example illustrated in FIG. 1, in other examples the coupling member 200 may be held to the plug 102 in other ways. For example, the plug 102 may include an outer lip (not shown) on an exterior surface of the plug's shell 106 and the inner lip 214 of the coupling member 200 may abut the outer lip of the plug's shell 106 to secure the coupling member 200 to the plug 102. In yet another example, the plug's shell 106 may include a groove (not shown) and the inner lip 214 of the coupling member 200 may fit within the groove to secure the coupling member 200 to the plug 102. For clarity, the coupling member 200 may be removably or non-removably secured to the plug 102 in any of the examples described herein. Also, the coupling member 200 may be rotatably secured to the plug 102 or non-rotatably secured to the plug 102. The engagement between the inner lip 214 of the coupling member 200 and the rear-facing surface 135 of the back end 133 of the plug 102 can provide some environmental sealing, such as dust and particulate sealing and also forms a treacherous path for any water sprayed at a high pressure, such that the high pressure water would blocked from the actual sealing area with the o-ring.

Referring again to FIG. 1, the sleeve's back section 204 may have a crash protection end portion 220 at its distal end 221 that is adjacent or near the latches 212. The crash protection end portion 220 may be, for example, an annular shoulder end portion, as seen in FIG. 1, that is configured to protect the flexible ends of the latches 212 from damage that may occur during shipping and handling of the connector.

The sealing member 300 may be disposed around the plug's outer shell 106 in the general area of the space 218 between the outer surface of the outer shell 106 and the inner surface of the sleeve 200. The sealing member 300 may be a piston or barrel seal, such as an O-ring or gasket made of a sealing material, such as rubber and the like. An annular channel or groove 301 may be provided in the outer surface of the shell 106 to hold the sealing member 300. The sealing member 300 can be positioned between the inner and outer diameters of the assembly 100 thereby generating compression to create an environmental seal sufficient for use of the assembly 100 in an outdoor environment. For example, the outer diameter may be that of the front end 130 of the plug's shell 106 and the inner diameter may be that of the body 12 of the support 10. As such, the sealing member 300 can be disposed between the plug's outer shell 106 and the body 12 supporting the receptacle 104. This positioning of the sealing member 300 separates the mating tightness of the assembly 100 from sealing performance. In other words, the sealing performance of the assembly 100 does not have to rely on the mating tightness of the assembly 100. The sealing member 300 provides a piston-type seal between overlapping mating diameters of the bore (jack receptacle 104) and shaft (plug 102). Therefore, the seal is maintained independent of the mating condition within a relatively large positional range defined by the length of the bore (jack receptacle 104) and shaft (plug 102) overlap. In comparison, a typical O-ring face seal, like the seal commonly found in a Type F connector, requires the mating interfaces to be clamped together with a coupling mechanism to achieve gasket compression and therefore sealing integrity. The sealing member 300 adds robustness and reliability to reduce connector field failures and associated repair costs, downtime, and customer dissatisfaction. In some examples, the outer shell 106 of the plug 102 may include one or more additional sealing members, for example, located on an exterior surface of the outer shell 106 for sealing with an inner surface of the coupling member 200.

When the plug 102 and receptacle 104 are initially mated as described above, the sleeve 200 may be pushed forward and rotated from its disengaged position to an engagement position in which the sleeve's inner threads 206 engage the outer threads 18 of the body 12 supporting the receptacle 104. This threaded engagement provides an additional mechanical connection for mating of the plug and receptacle 102 and 104, thereby increasing the mechanical strength of the assembly 100. For example, the threaded engagement between the sleeve's inner threads 206 and the outer threads 18 of the body 12 reduces the likelihood of unintentionally disengagement of the plug 102 from the receptacle 104. For example, when the sleeve's inner threads 206 are coupled to the outer threads 18 of the body, a pulling force on the cable C is primarily transferred through the sleeve 200 and the body 12 rather than the plug 102 and receptacle 104 themselves. Although a threaded engagement between the coupling member 200 and the support's body 12, is shown, any known mechanical engagement may be used, such a snapping, bayonet, or interference fit engagement and the like.

Figure 3A:
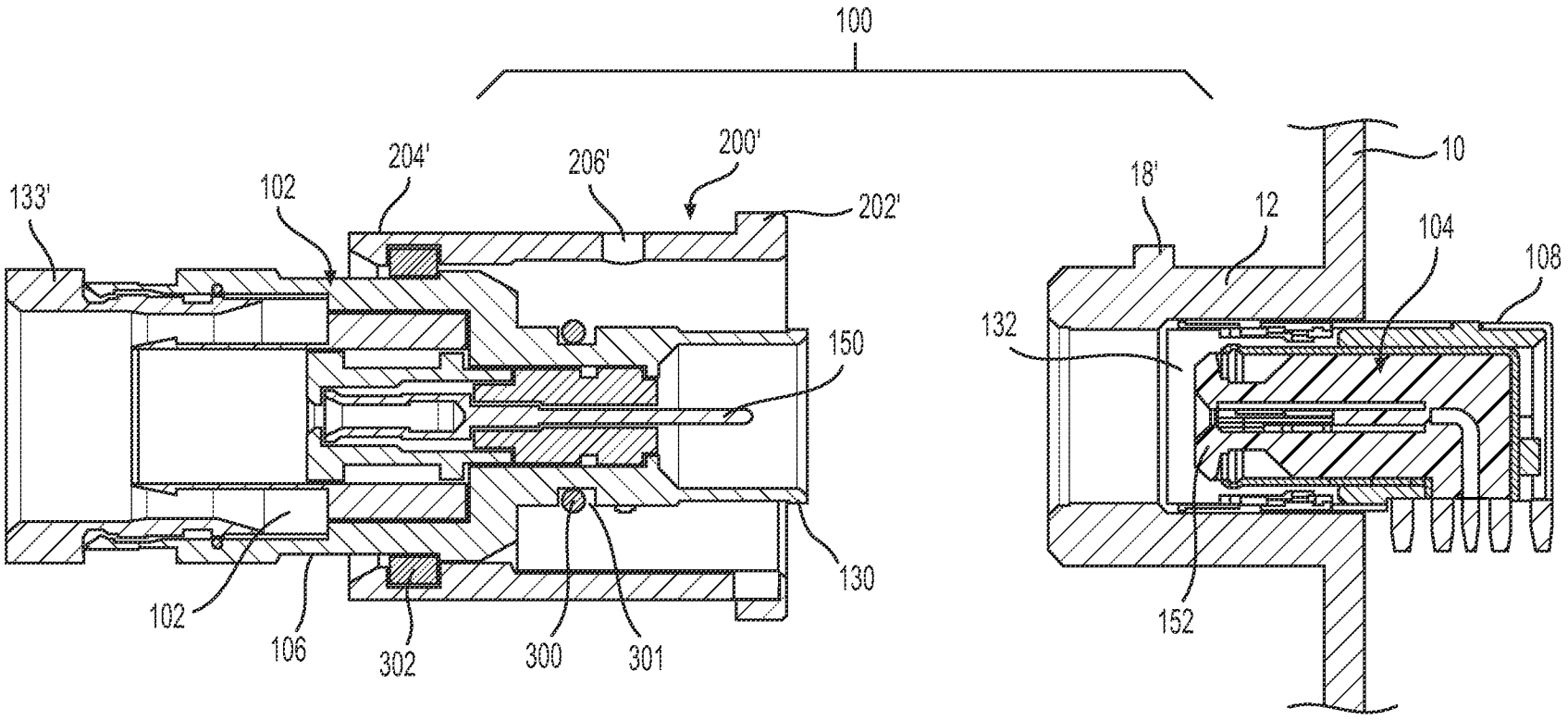
FIGS. 3*a*-3*c* are various exploded views of an electrical connector assembly thereof according to another example of the present disclosure.
Figure 3B:
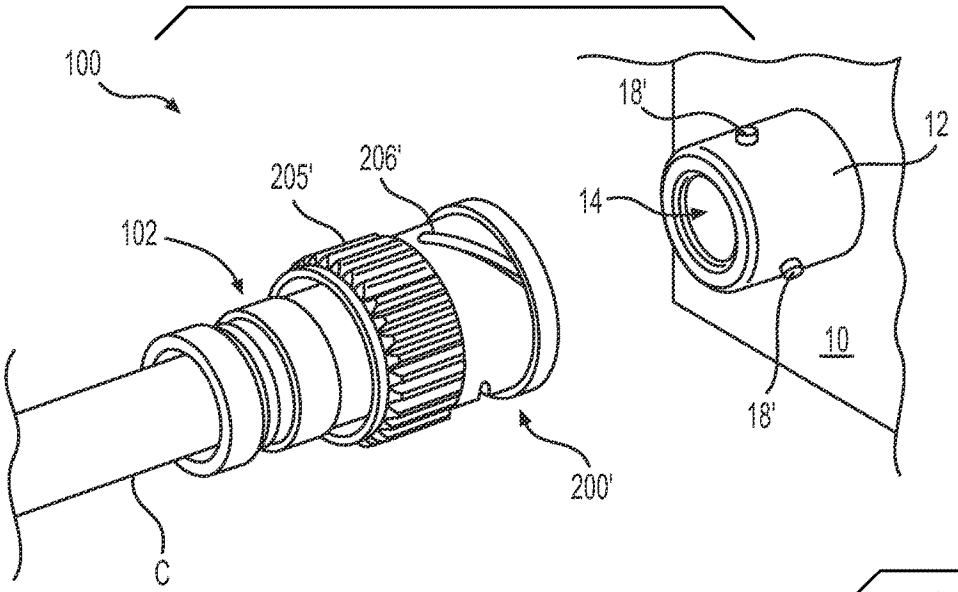
Figure 3C:
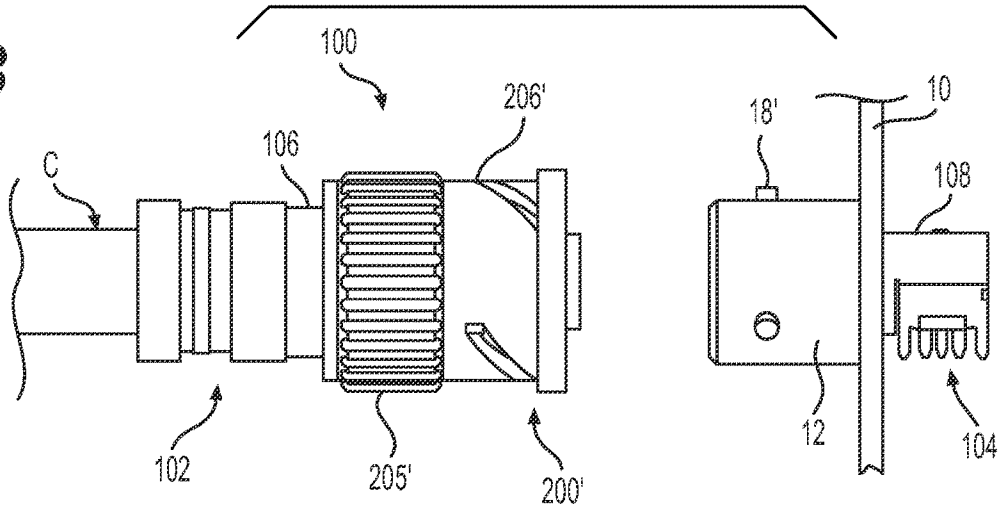

FIGS. 3*a*-3*c* illustrate another example of the present disclosure in which a bayonet engagement is provided between the coupling member 200' and the body 12 of the support 10. In this embodiment, the coupling member 200' is a sleeve. The sleeve 200' may have a shorter body length than the sleeve 200 of the embodiment above. Thus, for example, the coupling member 200' may not fully cover the back end 133' of the plug 102. The front 202' of the coupling member 200' includes bayonet engagement features 206' that mate with corresponding bayonet engagement features 18' of the body 12 of the support 10. The bayonet engagement features 206' may be curved ramps, for example, designed to receive the bayonet engagement features 18', such as be one or more spaced protrusions, for example, or vice versa. The body of the coupling member 200' may include a grooved outer surface 205' to facilitate gripping of the coupling member 200'. An inner secondary sealing member 302 (FIG. 3*a*), such an O-ring rubber gasket, may be provided at the back 204' of the coupling member 200' to provide additional sealing between the plug's shell 106 and the inside of the body of the coupling member 200'.

Figure 4A:
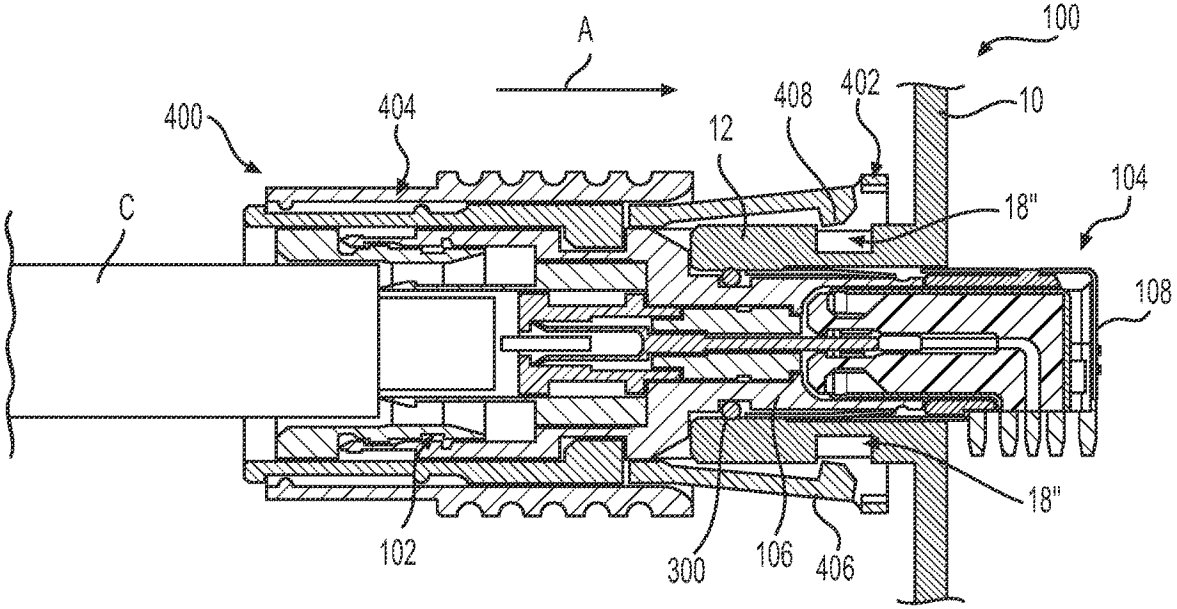
FIGS. 4*a*-4*d* are various cross-sectional and perspective views of an electrical connector and electrical connector assembly according to yet another example of the present disclosure.
Figure 4B:
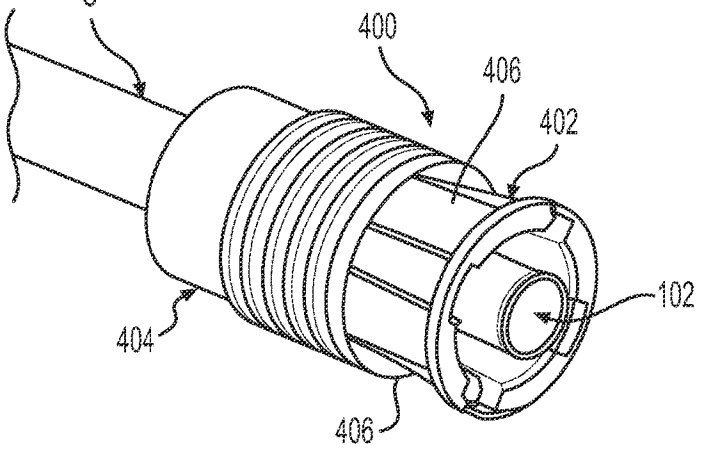
Figure 4C:
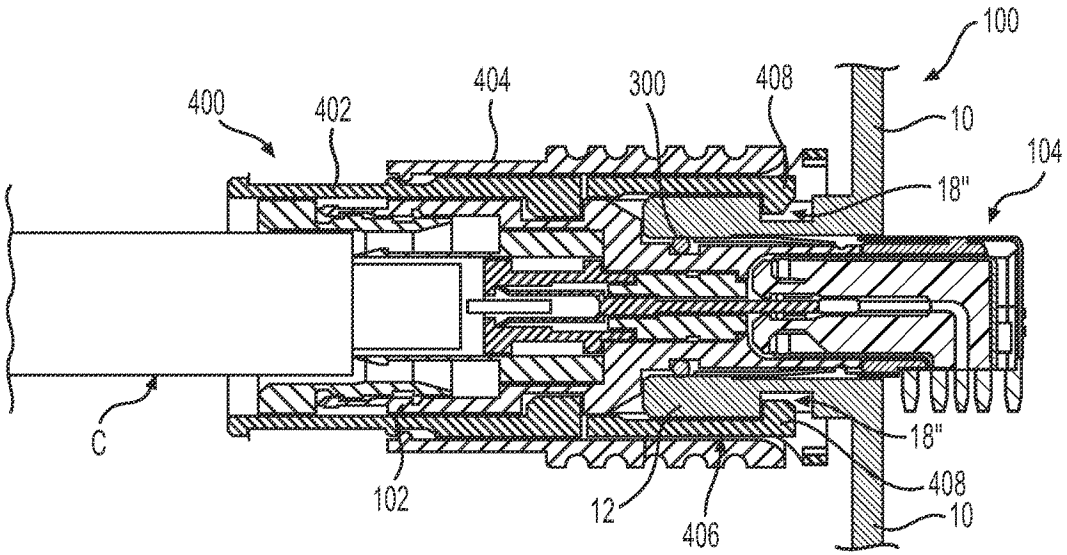
Figure 4D:
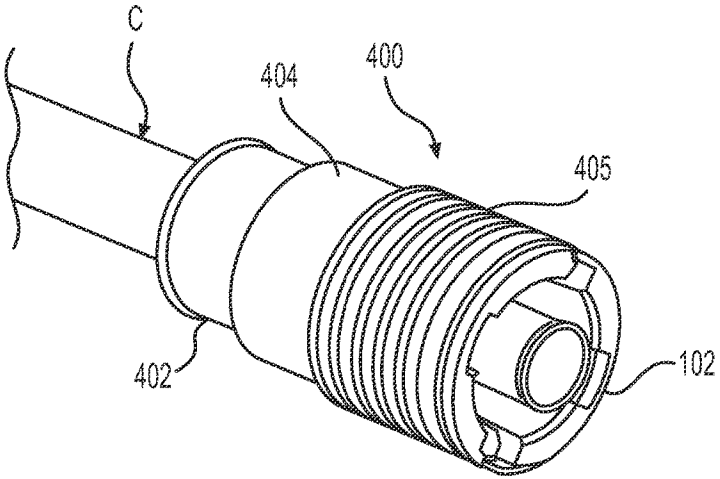

FIGS. 4*a*-4*d* illustrate yet another example of the present disclosure in which a coupling member 400 is provided that is configured to slide on and over the body 12 of the support 10 (holding receptacle 104) for engagement thereto. Coupling member 400 may be rotatably coupled to the plug's outer shell 106. The coupling member 400 may comprise an inner sleeve 402. The coupling sleeve 402 is designed to cooperate with an outer retaining member 404, which may be an outer sleeve. The outer retaining sleeve 404 is configured to slide axially over the inner coupling sleeve 402 between an unlocked position (FIGS. 4*a* and 4*b*) and a locked position (FIGS. 4*c* and 4*d*). A portion 405 of the outer surface of the outer retaining sleeve 404 may be knurled or grooved to assist with gripping. Inner coupling sleeve 402 may include an engagement feature, such as flexible spring arms 406, at its front end. The arms 406 engage a corresponding engagement feature, such as an annular groove 18", on the outer surface of the support's body 12. The distal end of each arm 406 may include an inner lip 408 that can fit or snap into the groove 18".

As seen in FIGS. 4*a*-4*d*, the coupling sleeve 402 may be configured to slide over the plug 102 to convert the plug 102 from an indoor-use version to an outdoor-use version. In some examples, the plug 102 is converted from an indoor-use version to an outdoor-use version with the addition of a sealing member 300 on the plug's conductive shell 106. In some examples, a field technician may install the sealing member 300 onto the plug's conductive shell 106 at a groove 301 on the plug's conductive shell 106. The sealing member 300 provides a sealing function between the plug's conductive shell 106 and the inner bore 14 of the body 12 of the support 10 when the plug 102 is coupled to the receptacle 104. In addition, prior to coupling the plug 102 and the receptacle 104, the field technician may also install the coupling sleeve 402 for additional weather proofing and to strengthen the engagement between the plug 102 and the receptacle 104. The field technician may slide the coupling sleeve 402 in an axial direction A to rotatably, and in some cases removably, secure the coupling sleeve 402 to the plug 102. Thus, the same plug 102 can be used for indoor applications as well as outdoor applications with the addition of the sealing member 300 and/or the coupling sleeve 402. In practice, a field technician can carry these parts (for example, the plug 102, the sealing member 300, and the coupling sleeve 402) to a job site and decide whether to use the plug 102 by itself (as an indoor-use version) or to use the plug 102, the sealing member 300, and/or the coupling member 400 (as an outdoor-use version) as needed. This eliminates the need for a field technician to carry both indoor-only versions of the plug and outdoor-only versions of the plug, thereby maximizing flexibility and minimizing connector variants in inventory.

When the connectors 102 and 104 are being mated, the coupling sleeve 402 engages the front end of the support's body 12 such that the latches 406 of the sleeve 402 expand outwardly with their inner lips 408 positioned over the support's annular groove 18", as seen in FIG. 4*a*, while the outer retaining sleeve 404 remains back in its unlocked position. The coupling sleeve 402 may be configured to be pushed over the front end of the support's body 12 to engage the same once the connectors 102 and 104 are mated. The outer retaining sleeve 404 can then slide axially with respect to the inner coupling sleeve 402 to its locked position in which is covers the arms 406 of the inner coupling sleeve 402, thereby retaining the coupling sleeve 402 in engagement with the support's body 12. That is, once inner coupling sleeve 402 has been appropriately positioned over the body 12 of the support 10, outer retaining sleeve 404 can then be moved axially to slide with respect to the coupling sleeve 402 toward support 10. As outer retaining sleeve 404 reaches the front end of coupling sleeve 402, the inner surface of outer retaining sleeve 404 covers and contacts the coupling sleeve's latches 406 to force the latches 406 inwardly so that their inner lips 408 engage the annular groove 18" of the body 12 of support 10, as seen in FIG. 4*c*, thereby retaining the lips 408 in the groove 18" to securely mating the components 102 and 104.

Figure 5B:
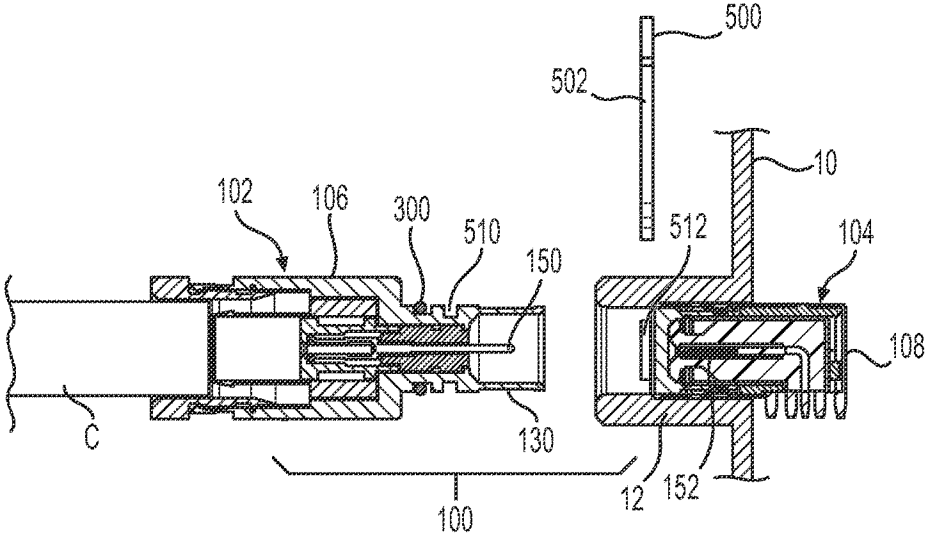
FIGS. 5*a*-5*c* are perspective and cross-sectional views of an electrical connector assembly according to still another example of the present disclosure.
Figure 5C:
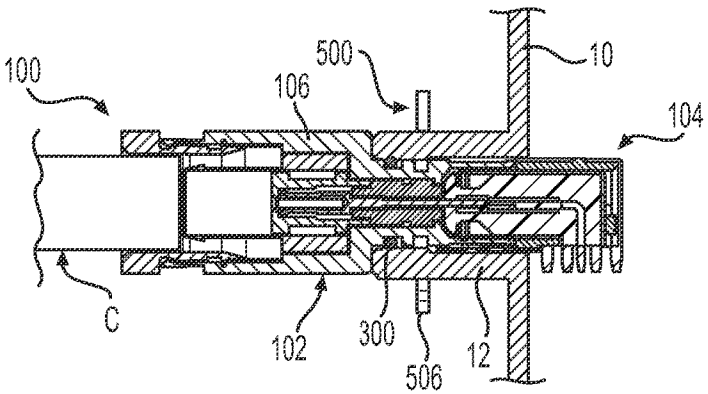
Figure 5A:
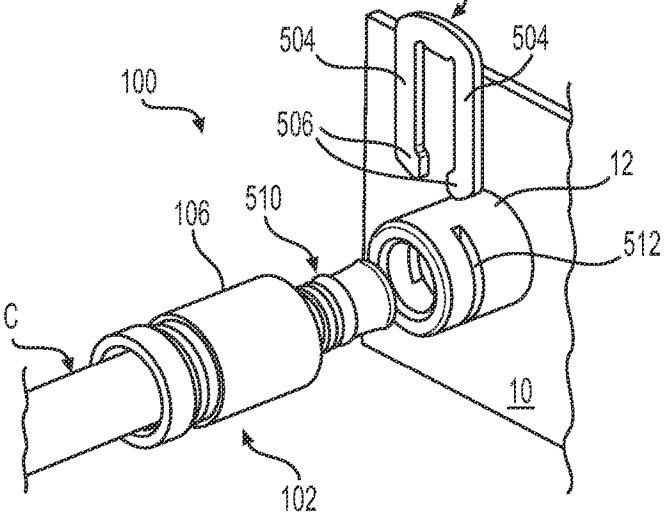

FIGS. 5*a*-5*c* illustrate still another example of the present disclosure in which the plug 102 is securely mated to the receptacle 104 and the support's body 12 by a coupling member 500. The coupling member 500 can be separate from the plug 102 and the receptacle 104. In this example, the coupling member 500 may be a spring clip configured to engage the front end 130 of the plug's shell 106 and the body 12 of support 10. Clip 500 may have a generally E-shaped or C-shaped body 502. The body 502 is generally flat in order to fit within a corresponding outer annular groove 510 of the plug 102 and a corresponding annular slot 512 of the support 10. The clip's body 502 has an open end that defines two legs 504. The distal end 506 of each leg 504 of clip 500 can have a generally hook shape, as best seen in FIG. 5*a*, to facilitate engagement with the support's body 12. The groove 510 of plug 102 can be provided near the front end 130 of the plug's shell 106, such as in front of sealing member 300, as seen in FIG. 5*b*. Similarly, the slot 512 of the body 12 of support 10 may be positioned near the front of body 12, as seen in FIG. 5*a*.

Once plug 102 and receptacle 104 are initially mated such that the pin 150 is received in the socket 152, as described above, clip 500 may be assembled onto the mated components to secure the engagement therebetween. The groove 510 of plug 102 and the slot 512 of the body 12 of support 10 are generally aligned when the plug 102 and receptacle 104 are initially mated. When assembling clip 500 to the mated components, the legs 504 of clip 500 may be inserted over and into the slot 512 of the support's body 12 until the distal ends 506 of the clip's legs 504 hook under the body 12 of support 10, seen in FIG. 5*c*. As clip 500 is being inserted into slot 512 of the support's body 12, the legs 504 of clip 500 also engage the outer groove 510 of the plug's shell 106.

Figure 7:
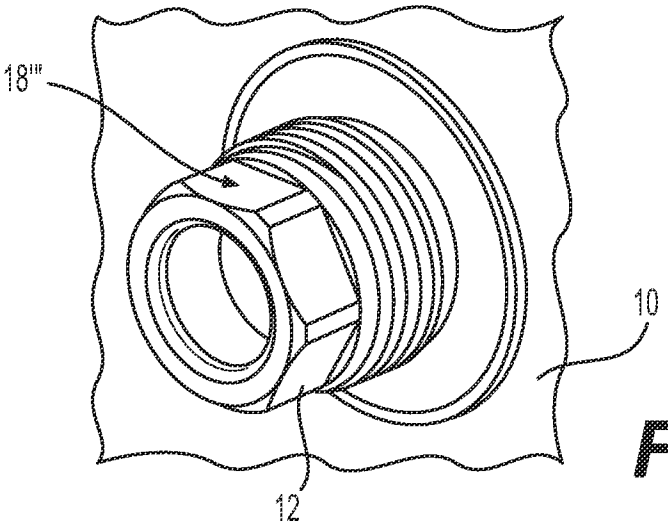
FIGS. 6 and 7 are views of alternative engagement features according to examples of the present disclosure.
Figure 6:
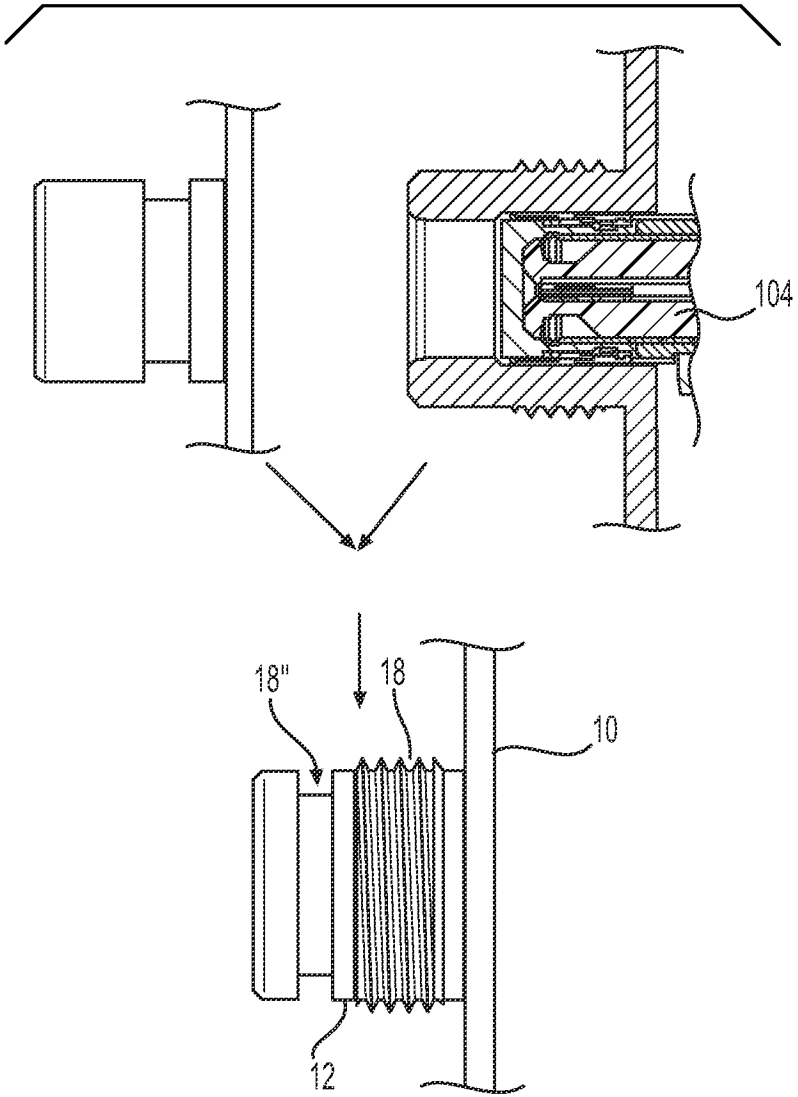

Other engagement features may be provided on the body 12 of support 10 for engaging the coupling members of the present disclosure. For example, the outer surface of the support's body may include a combination of the outer threads 18 and the annular groove 18", as seen in FIG. 6. Alternatively, the engagement mechanism can be made into a separate insert 18'" that is threaded into the support 10, as seen in FIG. 7.

FIGS. 8*a*-13*b* illustrate yet another example of a coupling member 600 of the present disclosure. The coupling member 600 may comprise a coupling sleeve 602. The sleeve 602 is disposed on the plug 102 and slidable forward relative thereto from a disengaged position (FIGS. 11*a* and 11*b*) to an engaged position (FIGS. 12*a* and 12*b*) in which the front section 603 of the sleeve 602 engages the body 12 of the support 10 in which the receptacle 104 is mounted.

The coupling sleeve 602 is disposed around at least a portion of the plug's conductive shell 106 when in use (FIGS. 12*a*-13*b*). The coupling sleeve 602 may have an elongated body 601 with a front section 603 and a back section 604. Front section 603 is configured to engage a corresponding component, such as the body 12 of the support 10, that is associated with the mating connector or receptacle 104, the receptacle 104 being mounted in the support 10, to strengthen the mechanically coupling of the plug 102 and receptacle 104 together. The front section 603 has an engagement feature, such as flexible snap arms 606. The arms 606 are configured to engage a corresponding component or engagement feature, such as an annular groove 18" (FIG. 6), of the body 12 of the support 10. The arms 606 engage the corresponding annular groove 18" on the outer surface of the support's body 12. The distal end of each arm 606 may include an inner lip that can fit or snap into the groove 18". The front section 603 may have a protective ring 605 (FIG. 10) at its distal front end to protect the flexible arms 606 from damage.

Figure 8A:
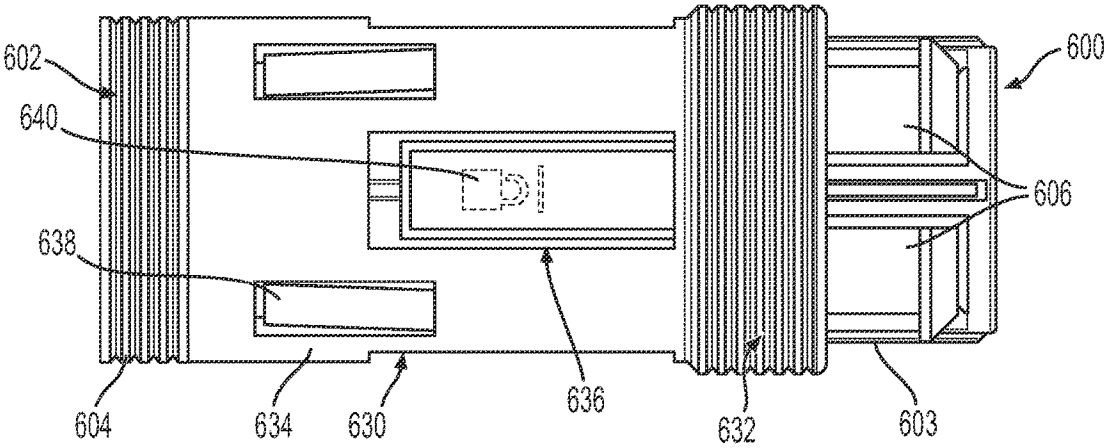
FIG. 8*a* is an elevational view of a coupling member and a retaining member according to a further example of the present disclosure, showing the retaining member in an unlocked position.
Figure 8B:
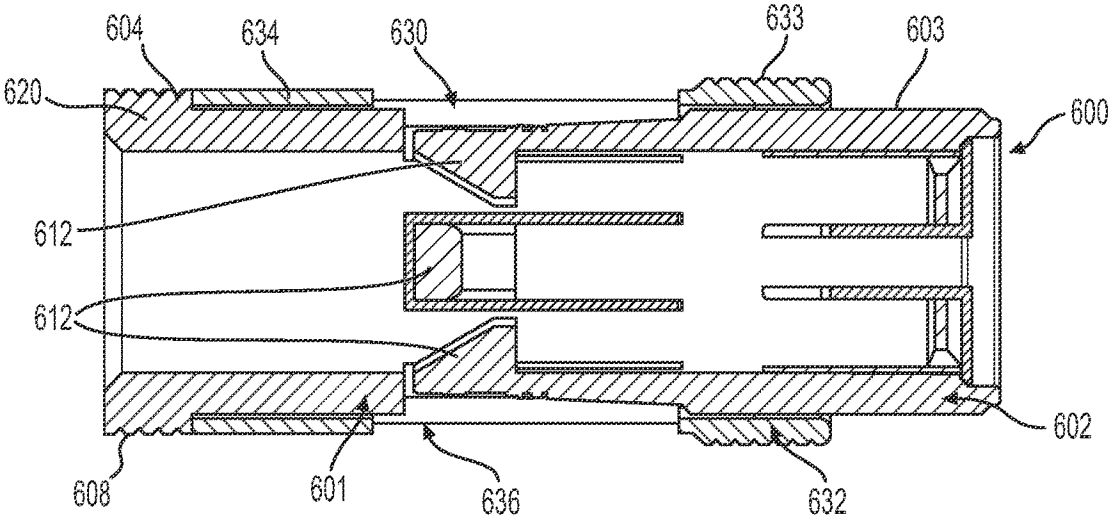
FIG. 8*b* is a cross-sectional view of the coupling and retaining members illustrated in FIG. 8*a;*

Referring to FIGS. 8*a* and 8*b*, the back section 604 of the sleeve 602 has an outer gripping surface 608 to facilitate moving of the sleeve 602 with respect to the plug 102. The back section 604 of the sleeve 602 is designed to accept and cover the terminated end of the cable C (see e.g., FIG. 12*b*). One or more flexible snap latches 612 can be provided in the coupling sleeve 602. The flexible snap latches 612 extend inwardly to engage the back end of the plug 102. The back section 604 of the sleeve 602 in the position shown in 12*b* is pushed over the plug 102, spreading open arms 612, until the spring arms 612 engage behind the plug 102. Each latch 612 can have an inner lip 614 extending inside of the sleeve 602. The inner lip 614 may be configured to snap over the back end 133 of the plug's shell 106, such that the inner lip 614 contacts the rear-facing surface 135 of the back end 133 of the plug 102 and such that the inner lips 614 act as a stop to secure (or at least removably secure) the coupling member 602 to the plug 102. A crash protection end portion 620 may be provided at the distal back end of the sleeve's back section 604 adjacent or near the flexible latches 612, as best seen in FIG. 9*b*, to protect the ends of the latches 612 from damage, such as possible damage due to shipping and handling of the connector.

As seen in FIGS. 12*a*-13*c*, the coupling sleeve 602 may be configured to slide over the plug 102 to convert the plug 102 from an indoor-use version to an outdoor-use version. In some examples, the plug 102 is converted from an indoor-use version to an outdoor-use version with the addition of a sealing member 300 on the plug's conductive shell 106. In some examples, a field technician may install the sealing member 300 onto the plug's conductive shell 106 at a groove 301 on the plug's conductive shell 106. The sealing member 300 provides a sealing function between the plug's conductive shell 106 and the inner bore 14 of the body 12 of the support 10 when the plug 102 is coupled to the receptacle 104. In addition, prior to coupling the plug 102 and the receptacle 104, the field technician may also install the coupling sleeve 602 for additional weather proofing and to strengthen the engagement between the plug 102 and the receptacle 104. The field technician may slide the coupling sleeve 602 in an axial direction over the plug 104 from the front of the plug to the back of the plug and can rest on the cable C until ready for use. To use the coupling sleeve 602, the coupling sleeve 602 slides axially with respect to the plug 102 in a direction A, to initially rotatably, and in some cases removably, secure the coupling sleeve 602 to the plug 102. Once the coupling sleeve 602 is positioned on the cable C (see, e.g., FIG. 11*a*), the plug 102 may be secured to the receptacle 104 (see, e.g., FIG. 11*a*) and the coupling sleeve 602 can be secured to the body 12 of the support 10. Thus, the same plug 102 can be used for indoor applications as well as outdoor applications with the addition of the sealing member 300 and/or the coupling sleeve 602. In practice, a field technician can carry these parts (for example, the plug 102, the sealing member 300, and the coupling sleeve 602) to a job site and decide whether to use the plug 102 by itself (as an indoor-use version) or to use the plug 102, the sealing member 300, and/or the coupling member 600 (as an outdoor-use version) as needed. This eliminates the need for a field technician to carry both indoor-only versions of the plug and outdoor-only versions of the plug, thereby maximizing flexibility and minimizing connector variants in inventory.

Figure 9A:
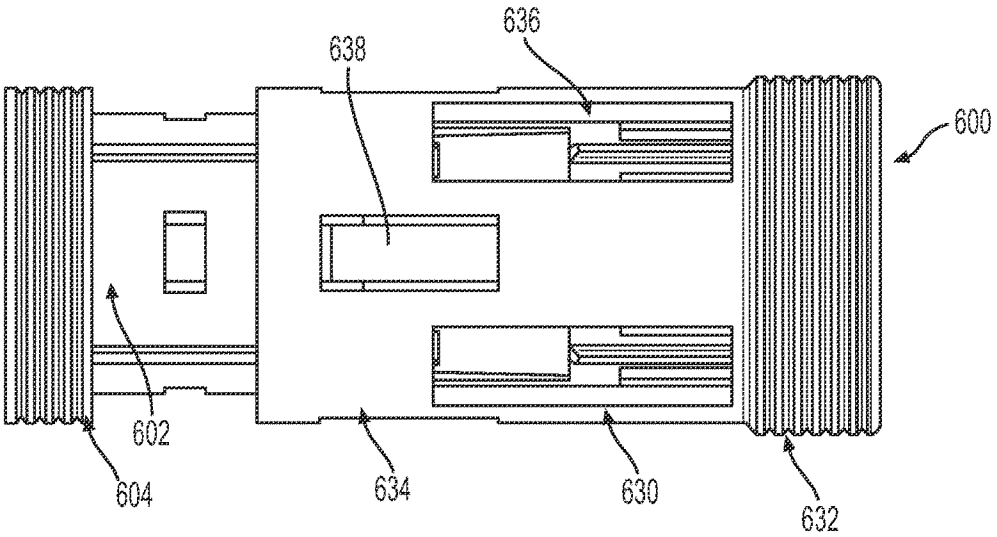
FIG. 9*a* is a cross-sectional view of the coupling and retaining members illustrated in FIG. 9*a;*
Figure 9B:
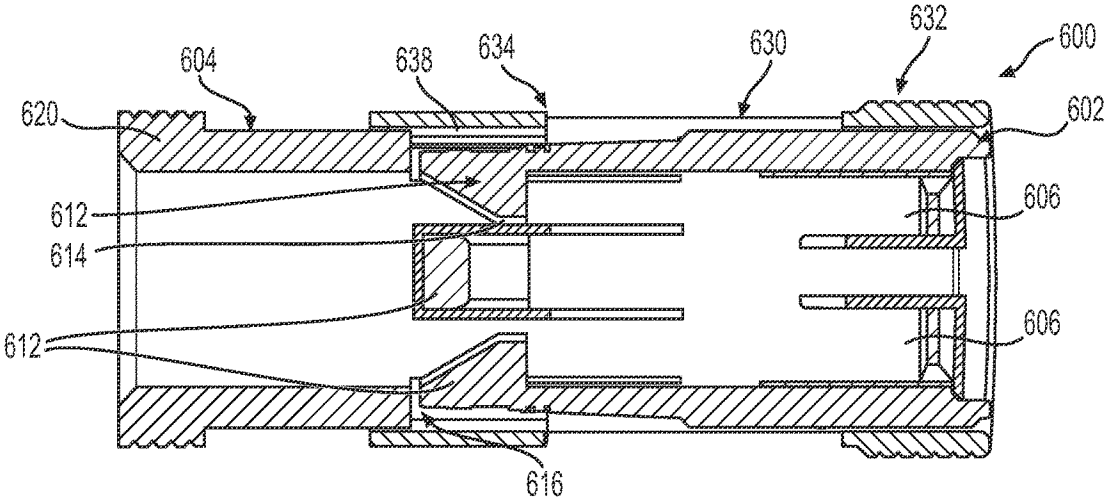
FIG. 9*b* is a cross-sectional view of the coupling and retaining members illustrated in FIG. 9*a;*
Figure 10:
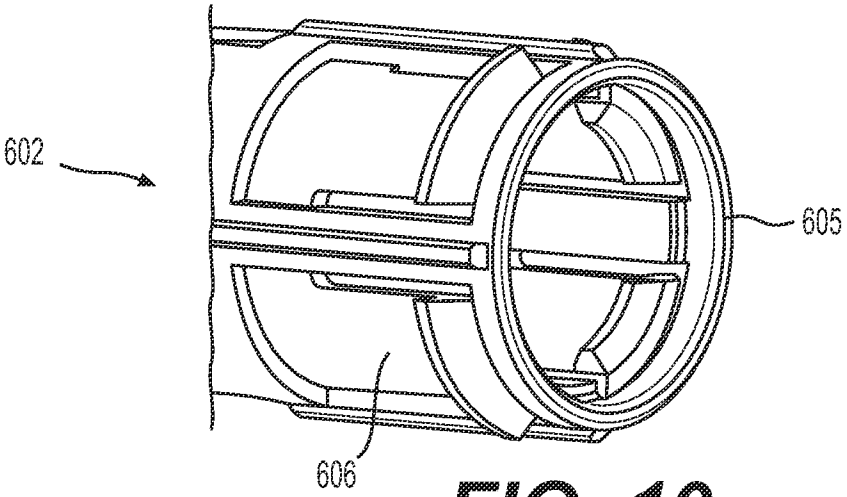
FIG. 10 is a partial enlarged view of the front of the coupling member illustrated in FIGS. 8*a*-9*b;*

Referring to FIGS. 8*a*-9*b*, in an example, the coupling sleeve 602 is designed to cooperate with a retaining member 630. The retaining member 630 may be disposed on at least a portion of the coupling sleeve 602 and is configured to slide with respect to the coupling sleeve 602 between an unlocked position (FIGS. 8*a* and 8*b*) and a locked position (FIGS. 9*a* and 9*b*). In one aspect, the retaining member 630 comprises an outer retaining sleeve disposed around the outer surface of the coupling sleeve 602. The outer retaining sleeve 630 can be assembled on the coupling sleeve 602 from the front section 603 of the coupling sleeve 602. The outer retaining sleeve 630 may have a front portion 632 generally corresponding to the front section 603 of the coupling sleeve 602 and a back portion 634 generally corresponding to the back section 604 of the coupling sleeve. A portion 633 (FIG. 8*b*) of the outer surface of the outer retaining sleeve 630 may be knurled or grooved to assist with gripping and sliding of the outer retaining sleeve 630 with respect to the coupling sleeve 602.

One or more windows 636 may be provided in the outer retaining sleeve 630. The windows 636 each correspond to one of the inwardly extending flexible latches 612 of the coupling sleeve 602, thereby allowing the latches 612 to expand when assembling the coupling sleeve 602 to the plug 102. Indicator indicia 640, such as text, a graphic, an icon, and the like, may be provided on the outer surface of the coupling sleeve 602, as seen in FIG. 8*a*. The indicia 640 can indicate whether the outer retaining sleeve 630 is locked or unlocked. For example, when the outer retaining sleeve 630 is in its unlocked position with respect to the coupling sleeve 602, the indicator indicia 640, such as a graphic of a lock that is depicted as being unlocked, is visible through one of the windows 636 of the retaining sleeve 630, as seen in FIG. 8*a*.

The outer retaining sleeve 630 may have one or more flexible fingers 638 (FIG. 8*b*) extending inwardly therefrom in the retaining sleeve's back portion 634. The flexible fingers 638 are designed to engage the coupling sleeve 602 when the outer retaining sleeve 630 is slid to the locked position. In an example, each finger 638 can drop or snap into a corresponding recess 616 on the outer surface of the coupling sleeve 602, as best seen in FIGS. 9*a* and 9*b*. The fingers 638 can be positioned between the windows 636 such that one finger 638 is between two of the windows 636.

Figure 11B:
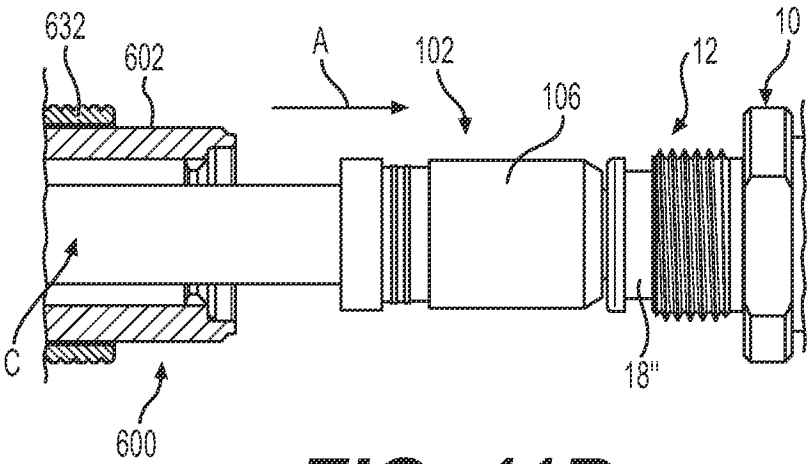
FIGS. 11*a* and 11*b* are elevational and cross-sectional views showing an electrical connector of the present disclosure in an initial mating position with a mating connector and the coupling member of FIG. 8*a* in a disengaged position.
Figure 11A:
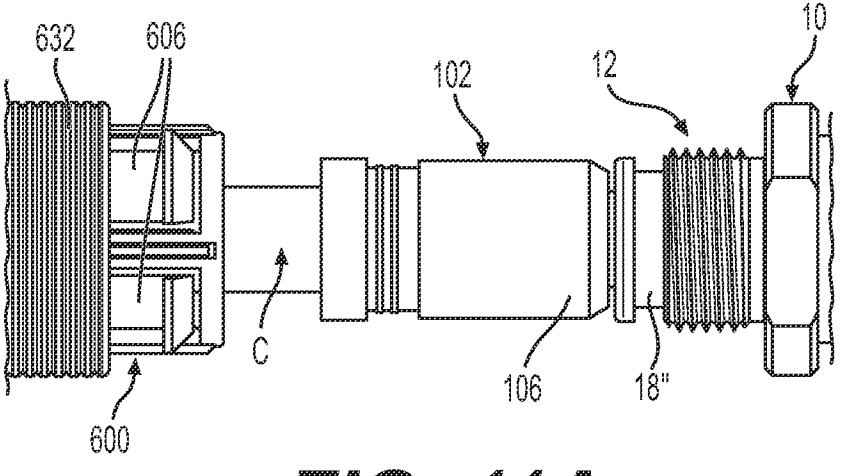
Figure 12B:
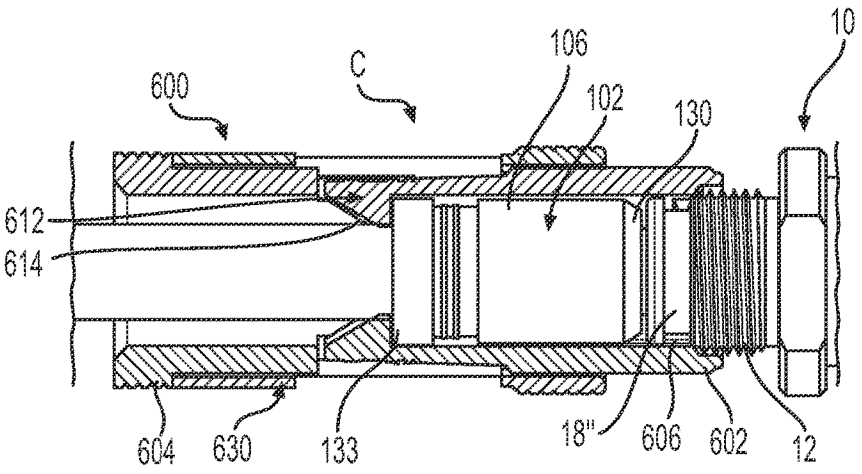
FIGS. 12*a* and 12*b* are elevational and cross-sectional views of the electrical connector assembly illustrated in FIGS. 11*a* and 11*b* with the coupling member thereof in an engaged position with the mating connector and the retaining member in an unlocked position.
Figure 12A:
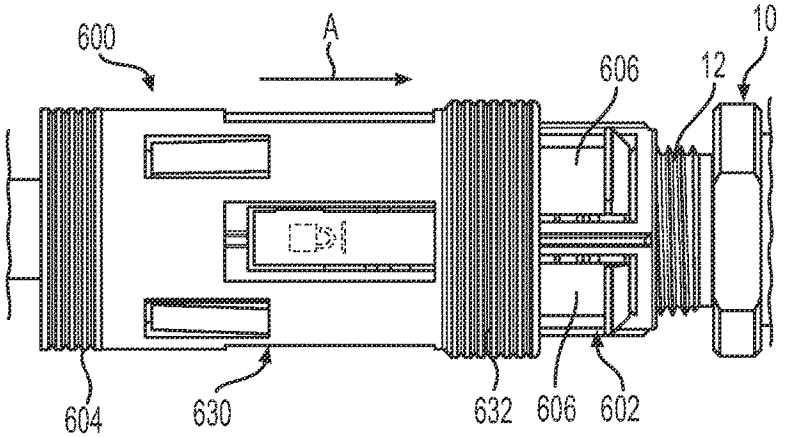

The coupling sleeve 602 with outer retaining sleeve 630 thereon can be assembled onto the plug 102. The coupling sleeve 602 may be configured to be pushed over the front end of the support's body 12, in which the receptacle 104 (FIG. 6.) is mounted, to engage the same once the connectors 102 and 104 are initially mated, as seen in FIGS. 11*a* and 11*b*. The coupling sleeve 602 can then be slid in the axial direction A with respect to the plug's shell 106 and moved forward towards the front end 130 of the plug 102. This moves the coupling sleeve 602 from its disengaged position, i.e. disengaged from the support 10 for the mating connector or receptacle, towards its engaged position in which the coupling sleeve's front section 603 engages the support's body 12 in which the receptacle is mounted, as seen in FIGS. 12*a* and 12*b*. In its engaged position, the flexible snap arms 606 at the front end the coupling sleeve 602 engage a corresponding component associated with the receptacle, for example, the annular groove 18" of the body 12 of the support 10. The flexible snap arms 606 are designed to flex and open outwardly in order to engage the support's body 12 and can provide an audible and tactile feedback of the sleeve's engaged position when snapped into place in the annular groove 18".

Figure 13B:
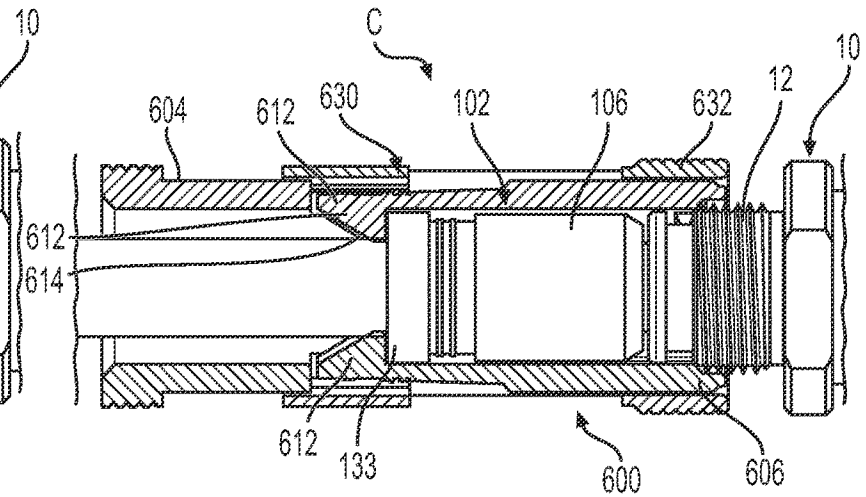
FIGS. 13*a* and 13*b* are elevational and cross-sectional views similar to FIGS. 12*a* and 12*b* of the electrical connector assembly, showing the retaining member in a locked position.
Figure 13A:
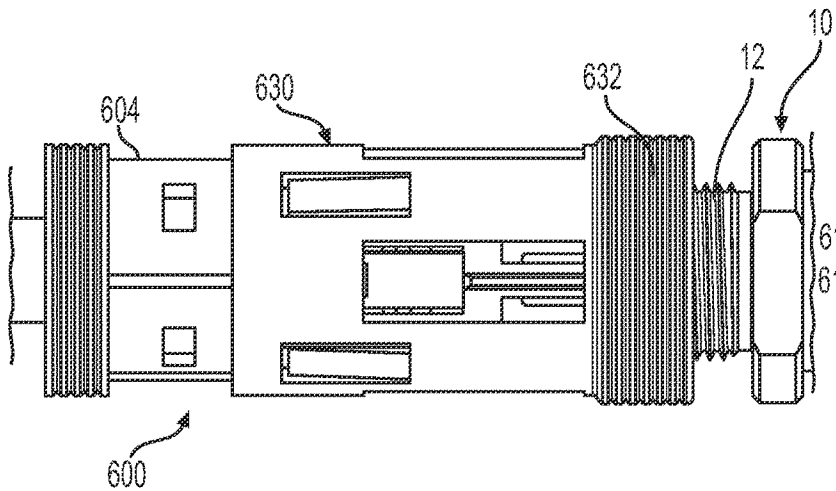
Figure 13C:
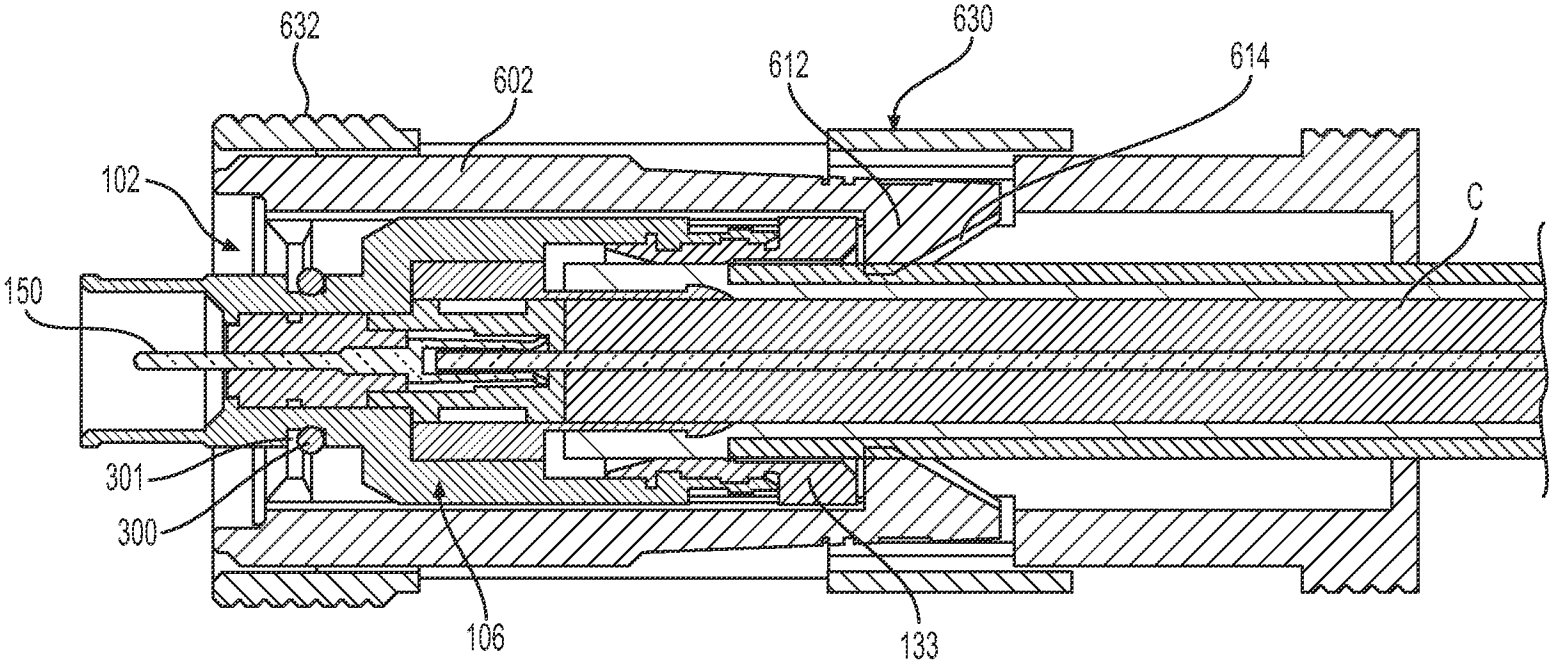
FIG. 13*c* is a cross-sectional view of the electrical connector illustrated in FIG. 13*b*, showing the retaining member in the locked position.
Figure 13D:
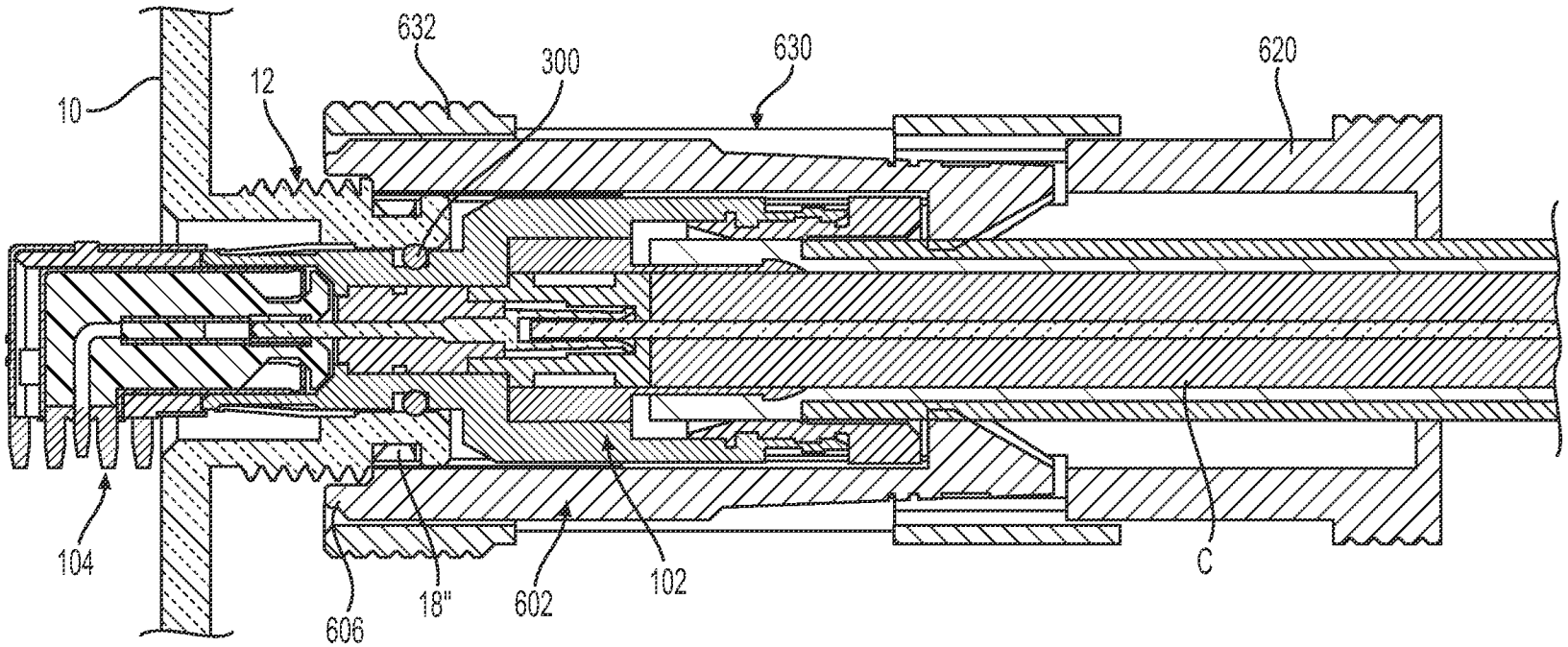
FIG. 13*d* is a cross-sectional view of the electrical connector assembly illustrated in FIG. 13*b;*

The outer retaining sleeve 630 is configured to slide axially in the direction A with respect to the coupling sleeve 602 between an unlocked position (FIGS. 12*a* and 12*b*) and a locked position (FIGS. 13*a* and 13*b*) once the coupling sleeve 602 engages the body 12 of the support 10. While sliding the coupling sleeve 602 to its engaged position with the support's body 12, the outer retaining sleeve 630 remains in its unlocked position with respect to the coupling sleeve 602, as seen in FIGS. 12*a* and 12*b*. The outer retaining sleeve 630 can then be moved forward with respect to the coupling sleeve 602 to its locked position in which the retaining sleeve 630 covers both the inwardly extending latches 612 and the snap arms 606 of the coupling sleeve 602 to secure latches 612 and arms 606 in place, as seen in FIGS. 13*a* and 13*b*. This keeps or retains the coupling sleeve 602 in engagement with the support's body 12 to secure the mechanical coupling of the plug and receptacle. That is, once the front section 603 of coupling sleeve 602 has been appropriately positioned over the body 12 of the support 10 and engaged therewith, the outer retaining sleeve 630 can then be moved axially to slide with respect to the coupling sleeve 602 toward support 10. As outer retaining sleeve 630 reaches the front end of coupling sleeve 602, the inner surface of outer retaining sleeve 630 covers and contacts the coupling sleeve's arms 606 to prevent the arms 606 from opening, thereby keeping the arms 606 in engagement with the annular groove 18" of the body 12 of support 10 to securely mate the components 102 and 104.

Figure 14A:
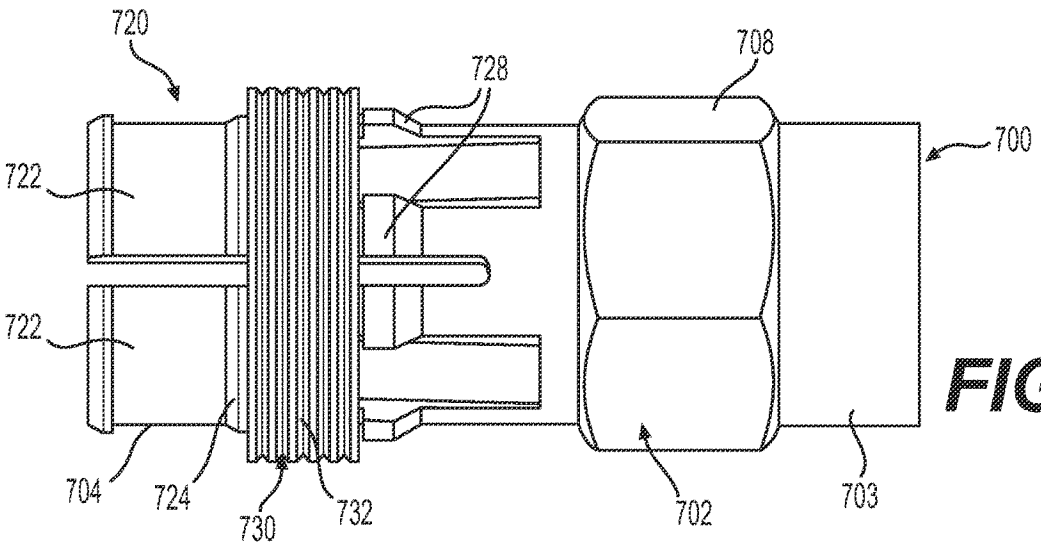
FIG. 14*a* is an elevational view of another coupling member and another retaining member according to an example of the present disclosure.
Figure 14B:
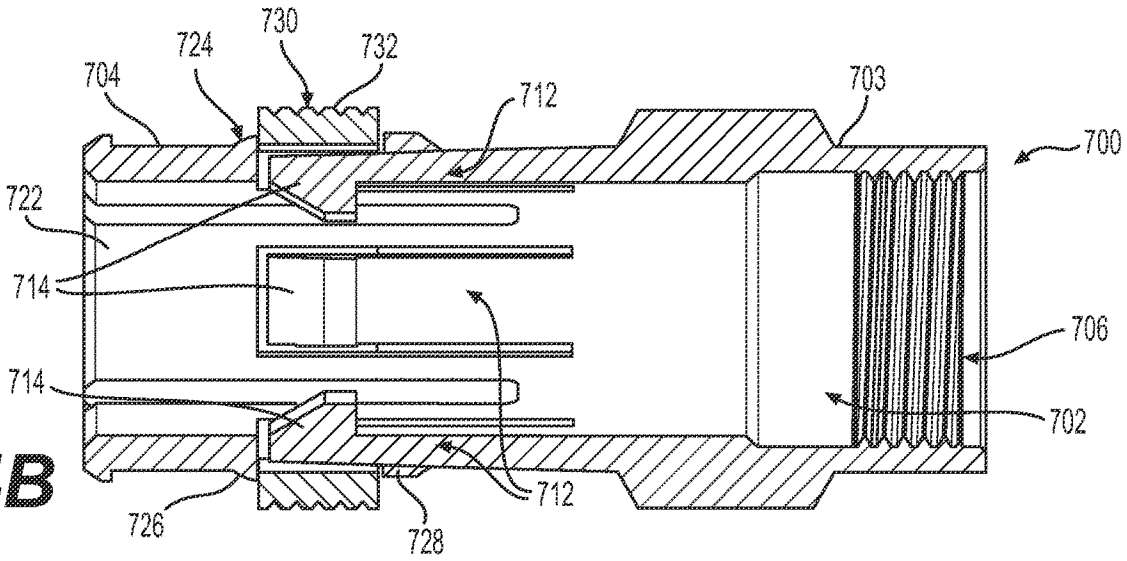
FIG. 14*b* is a cross-sectional view of the coupling and retaining members illustrated in FIG. 14*a;*
Figure 15B:
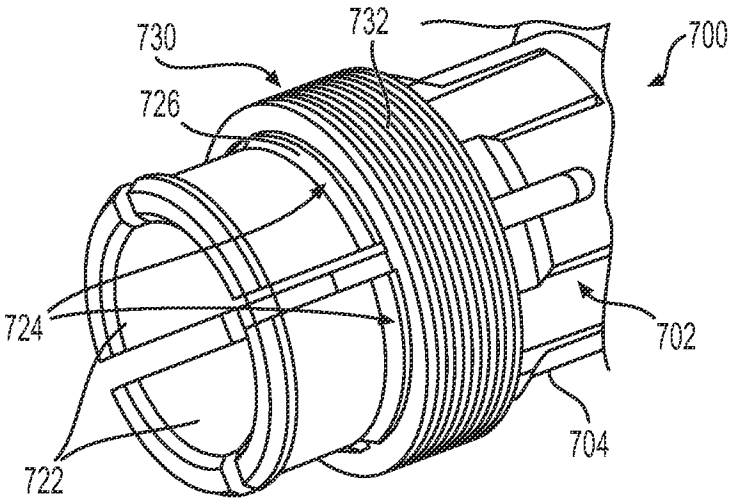
FIGS. 15*a* and 15*b* are partial end perspective views of the coupling and retaining members illustrated in FIGS. 14*a* and 14*b*, showing the retaining member in unlocked and locked positions, respectively.

FIGS. 14*a*-15*b* illustrate another coupling member 700 and another retaining member 730 according to an example of the present disclosure. Like the coupling member 600 of the above example, the coupling member 700 can comprise a sleeve 702 configured to engage both the plug 102 and the body 12 of the support 10 (which holds the receptacle 104). And like the retaining member 630 of the above example, the retaining member 730 is designed to slide with respect to the coupling sleeve 702 between an unlocked position (FIG. 15*a*) to a locked position (FIG. 15*b*).

The coupling sleeve 702 can be disposed around at least a portion of the plug's conductive shell 106. The coupling sleeve 702 may have an elongated body with a front section 702 and a back section 704. Like the coupling sleeves described above, the coupling sleeve 702 is configured to slide and move with respect to the plug 102 between disengaged and engaged positions. The front section 703 of the sleeve 702 is configured to engage the corresponding component, such as the body 12 of the support 10 that is associated with the mating connector or receptacle 104. The front section 703 has an engagement feature, such as inner threads 706, which is are configured to engage the corresponding component or engagement feature, such as outer threads 18 (FIG. 1), of the body 12 of the support 10, to mechanically couple the coupling sleeve 702 to the body 12 of the support 10.

The coupling sleeve 702 may have an outer gripping surface 708 near its front section 703 to facilitate application of torque and rotation of the sleeve 702 when engaging the front section 702 of the sleeve 702 with the outer threads 18 of the support's body 12. The back section 704 of the sleeve 702 is designed to accept and cover the terminated end of the cable C (FIG. 1). One or more inwardly extending flexible snap latches 712 can be provided in the coupling sleeve 702 near its back section 704. The latches 712 engage the back end of the plug 102. Each latch 712 can have an inner lip 714 extending inside of the sleeve 702. Each inner lip 714 may be configured to snap over the back end 133 of the plug's shell 106, such that each inner lip 714 contacts the rear facing surface 135 of the back end 133 of the plug 102 and such that the inner lips 714 act as a stop to secure (or at least removably secure) the coupling member 700 to the plug 102. A crash protection end portion 720 may be provided at the back section 704 of the sleeve 702. The protection end portion 720 is adjacent or near the flexible latches 712, as best seen in FIGS. 14*a* and 14*b*, to protect the ends 714 of the latches 712 from damage, such as possible damage due to shipping and handling of the connector. The crash protection end portion 720 may comprise, for example, one or more flexible tines 722. Each flexible tine 722 may have a ramp 724 adjacent the ends 714 of the latches 712.

The coupling sleeve 702 may be configured to slide over the plug 102 to convert the plug 102 from an indoor-use version to an outdoor-use version. In some examples, the plug 102 is converted from an indoor-use version to an outdoor-use version with the addition of a sealing member 300 on the plug's conductive shell 106 (see, e.g., FIG. 13*d*). In some examples, a field technician may install the sealing member 300 onto the plug's conductive shell 106 at a groove 301 on the plug's conductive shell 106. The sealing member 300 provides a sealing function between the plug's conductive shell 106 and the inner bore 14 of the body 12 of the support 10 when the plug 102 is coupled to the receptacle 104. In addition, prior to coupling the plug 102 and the receptacle 104, the field technician may also install the coupling sleeve 702 for additional weather proofing and to strengthen the engagement between the plug 102 and the receptacle 104. The field technician initially slides the coupling sleeve 702 over the plug 102 and onto the cable C until ready for use. To use the coupling sleeve 702, the coupling sleeve 702 slides axially with respect to the plug 102 in a direction A to rotatably, and in some cases removably, secure the coupling sleeve 702 to the plug 102. Thus, the same plug 102 can be used for indoor applications as well as outdoor applications with the addition of the sealing member 300 and/or the coupling sleeve 702. In practice, a field technician can carry these parts (for example, the plug 102, the sealing member 300, and the coupling sleeve 702) to a job site and decide whether to use the plug 102 by itself (as an indoor-use version) or to use the plug 102, the sealing member 300, and/or the coupling member 700 (as an outdoor-use version) as needed. This eliminates the need for a field technician to carry both indoor-only versions of the plug and outdoor-only versions of the plug, thereby maximizing flexibility and minimizing connector variants in inventory.

Figure 15A:
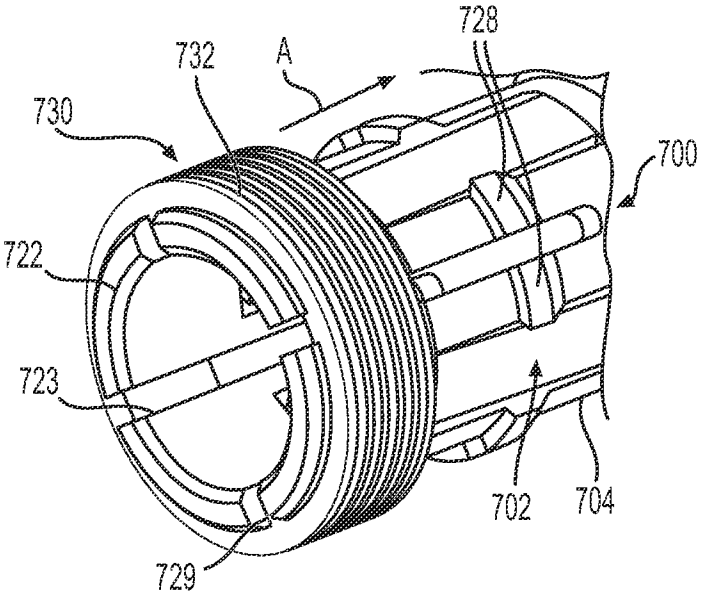

In this aspect of the present disclosure, the retaining member 730 comprises an outer ring body 732 disposed around the outer surface of the coupling sleeve 702 at the back section 704 thereof. The outer ring body 732 can be assembled onto the back of the coupling sleeve 702 around the protection tines 722, as seen in FIG. 15*a*, in its unlocked position. The outer surface of the outer ring body 732 may be knurled or grooved to assist with gripping and sliding of the outer ring body 732 with respect to the coupling sleeve 702.

The outer ring body 732 can be moved forward with respect to the coupling sleeve 702 from its unlocked position to a locked position, as seen in FIGS. 14*b* and 15*b*. In the unlocked position, the outer ring body 732 rests on the protection tines 722 of the sleeve 702 adjacent to the ramps 724 of the tines 722. In the locked position, the outer ring body 732 covers the inwardly extending latches 712 of the coupling sleeve 702 to prevent the latches for opening and disengaging from the back of the plug 102. When locking, the outer ring body 732 can slide forward over ramped surfaces 726 of the ramps 724 of the tines 722 and drop in behind the ramps 724, as seen in FIG. 14*b*. One or more outer ribs 728 may be provided on the outer surface of the coupling sleeve 702 which stop the forward movement of the outer ring body 732. This keeps or retains the coupling sleeve 702 in engagement with the plug 102. That is, as the outer ring body 732 is slid axially forward in the axial direction A, the outer ring body 732 covers the ends 714 of the sleeve's latches 712, as seen in FIG. 14*b*, thereby keeping the latches 712 in engagement with the plug's shell 106 (FIG. 11*b*). And the ramps 724 impede the outer ring 732 from moving or sliding back in the opposite direction and uncovering the latches 712. Only with a sufficient force can the outer ring body 732 move backwards over the ramps 724 after being locked. The outer ring body 732 of the retaining member 730 may optionally include one or more inner keys 729. The keys 729 cooperate with slots 723 between the tines 722 for alignment purposes.

Figure 16A:
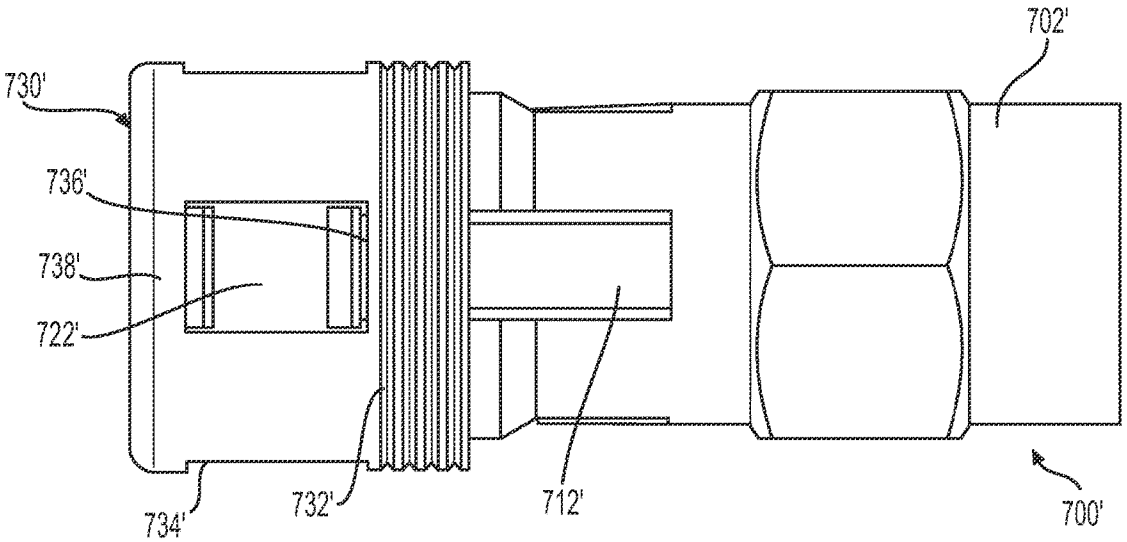
FIG. 16*a* is an elevational view of a coupling member and a retaining member according to still another example of the present disclosure.
Figure 16B:
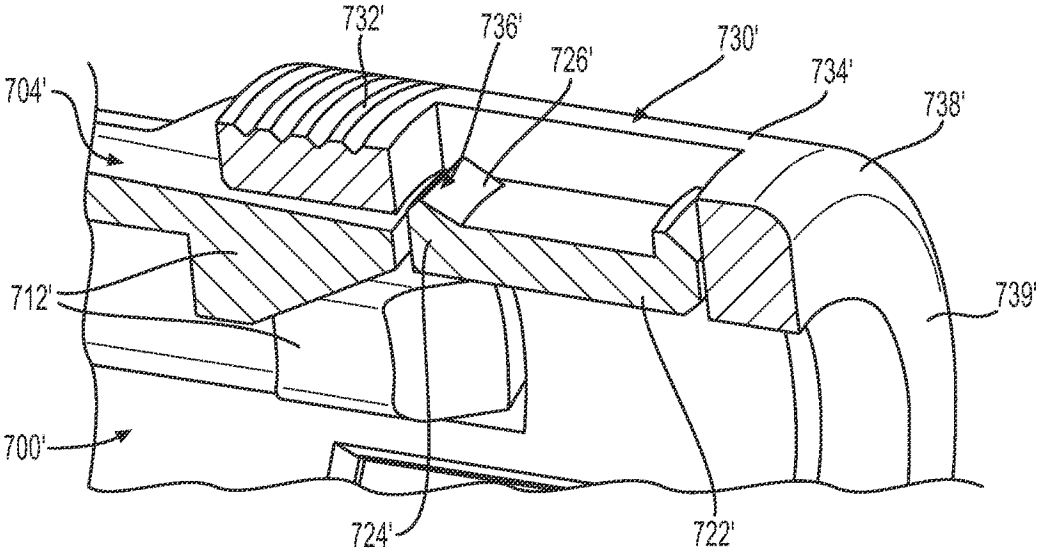
FIG. 16*b* is a partial cross-sectional end view of the coupling and retaining members illustrated in FIG. 16*a*, showing the retaining member in the locked position.

FIGS. 16*a* and 16*b* illustrate coupling and retaining members 700' and 730' that are modifications of the coupling and retaining members 700 and 730 described above. The coupling member 700' may comprise a sleeve 702'. The sleeve 702' has a front section 703' and a back section 704'. The front section 703' is configured to engage the corresponding component, such as the body 12 of the support 10, that is associated with the mating connector or receptacle 104. The front section 702' has an engagement feature, such as inner threads 706', which is are configured to engage a corresponding component or engagement feature, such as outer threads 18, of the body 12 of the support 10, to mechanically couple the coupling member 702' to the body 12 of the support 10. The coupling sleeve 702' also includes inwardly extending flexible latches 712' that engage the back of the plug 102. Each latch 712' can have an inner lip 714' extending inside of the sleeve 702'. Each inner lip 714' may be configured to snap over the back end 133 of the plug's shell 106, such that each inner lip 714' contacts the rear facing surface 135 of the back end 133 of the plug 102 and such that the inner lips 714' act as a stop to secure (or at least removably secure) the coupling member 700' to the plug 102.

Figure 17A:
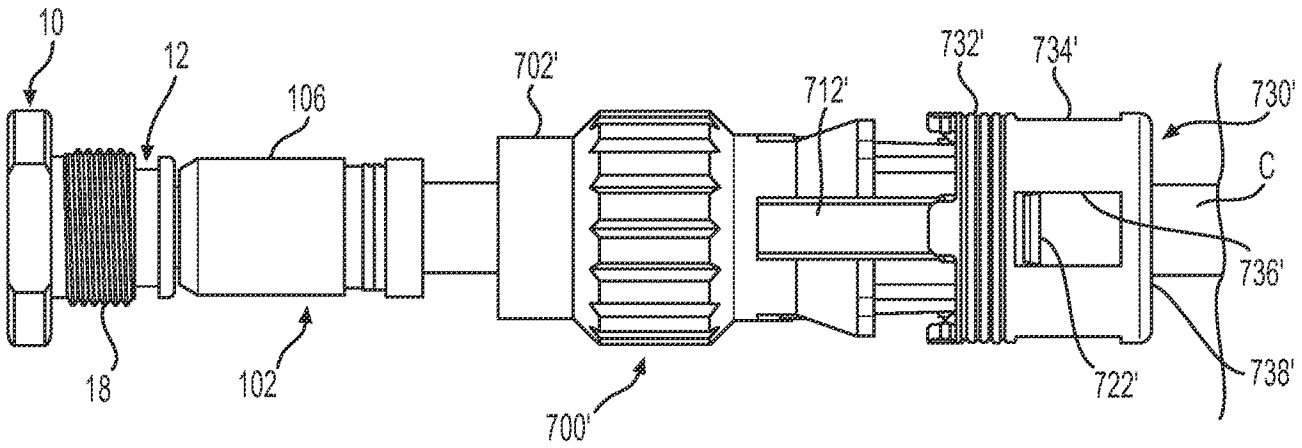
FIGS. 17*a* and 17*b* are elevational and cross-sectional views showing an electrical connector of the present disclosure in an initial mating position with a mating connector and the coupling member of FIG. 16*a* in a disengaged position.
Figure 17B:
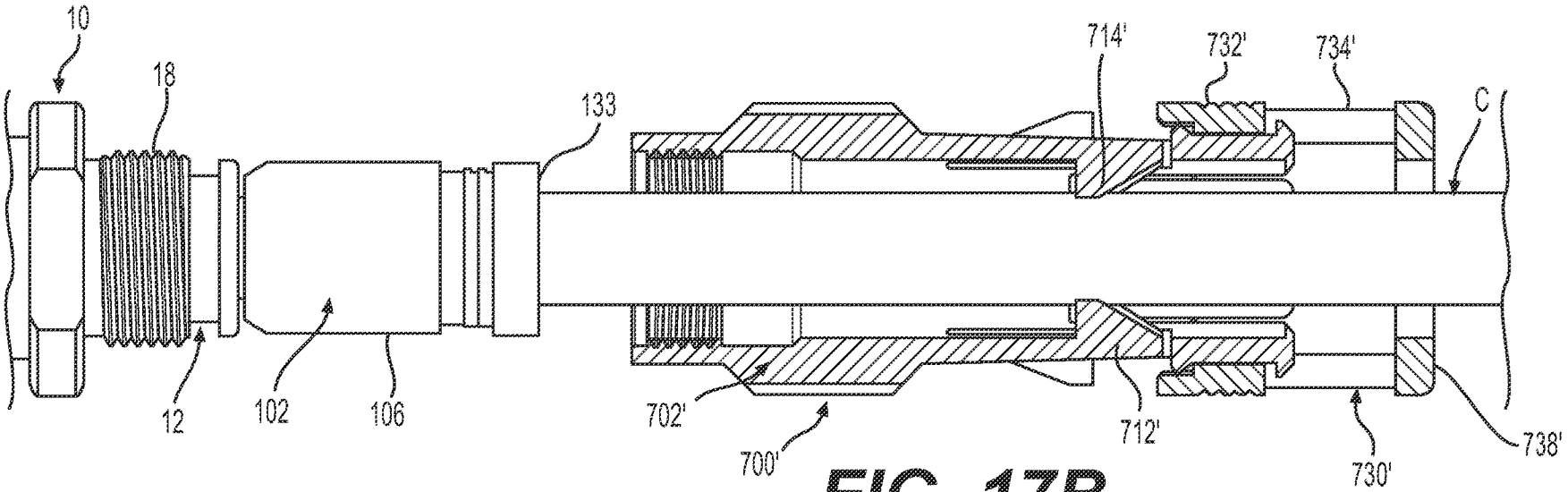
Figure 17C:
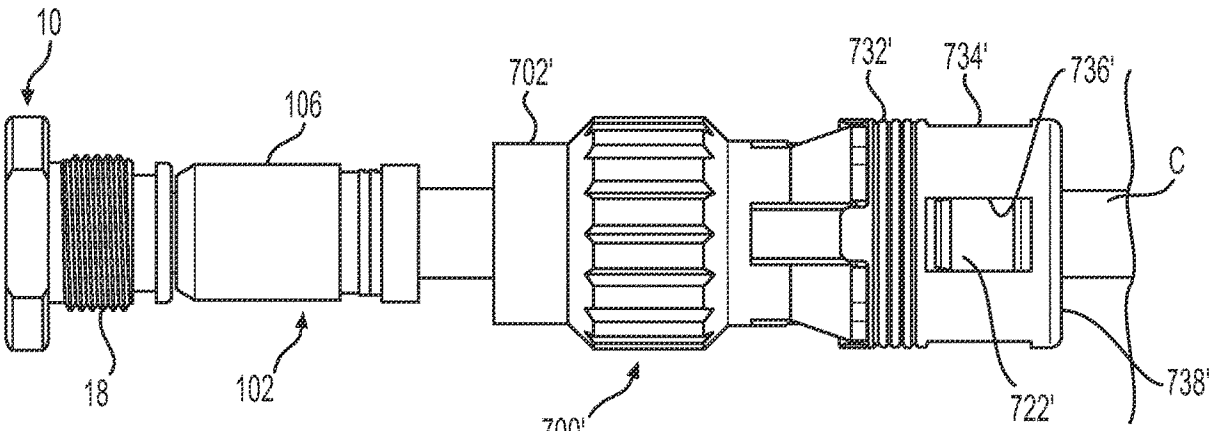
FIGS. 17*c* and 17*d* are elevational and cross-sectional views of the electrical connector assembly illustrated in FIGS. 17*a* and 17*b* with the coupling member thereof in an engaged position with the mating connector and the retaining member in an unlocked position.
Figure 17D:
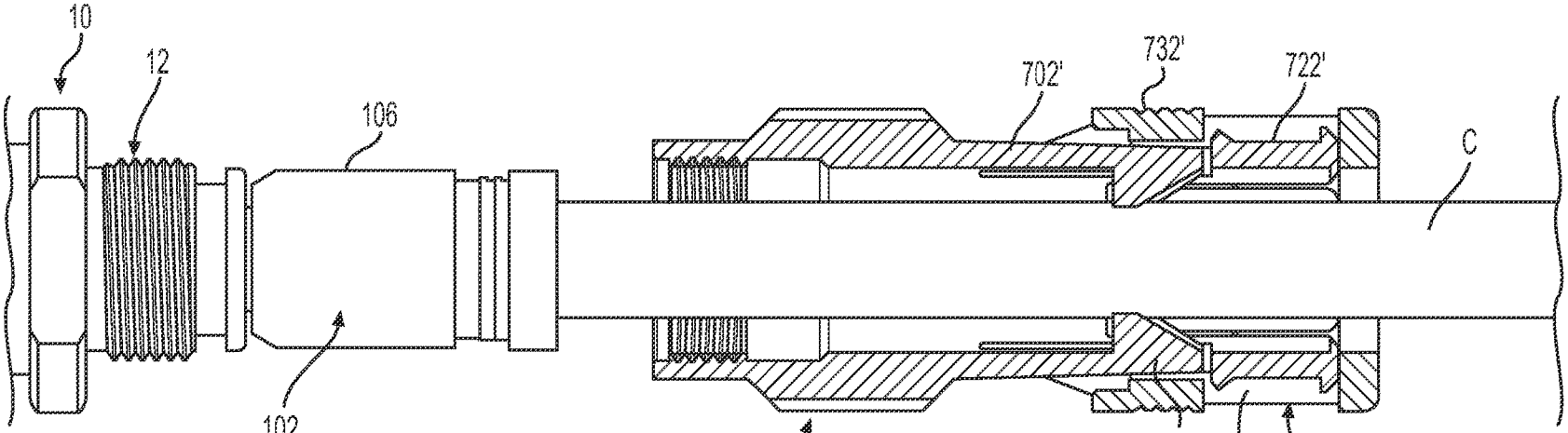
Figure 17E:
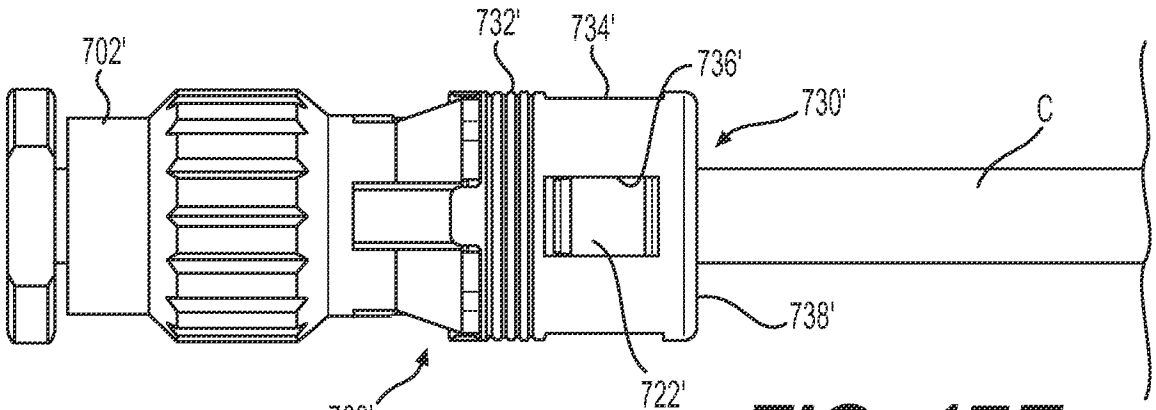
FIGS. 17*e* and 17*f* are elevational and cross-sectional views similar to FIGS. 17*c* and 17*d* of the electrical connector assembly, showing the retaining member in a locked position.
Figure 17F:
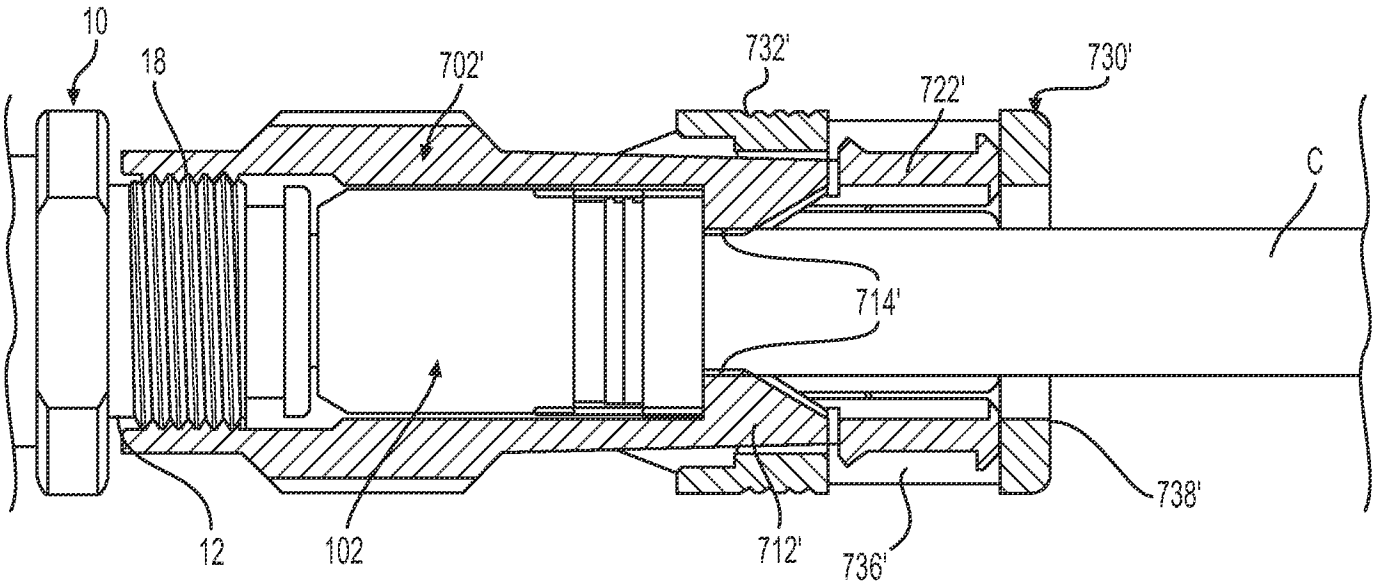
Figure 17G:
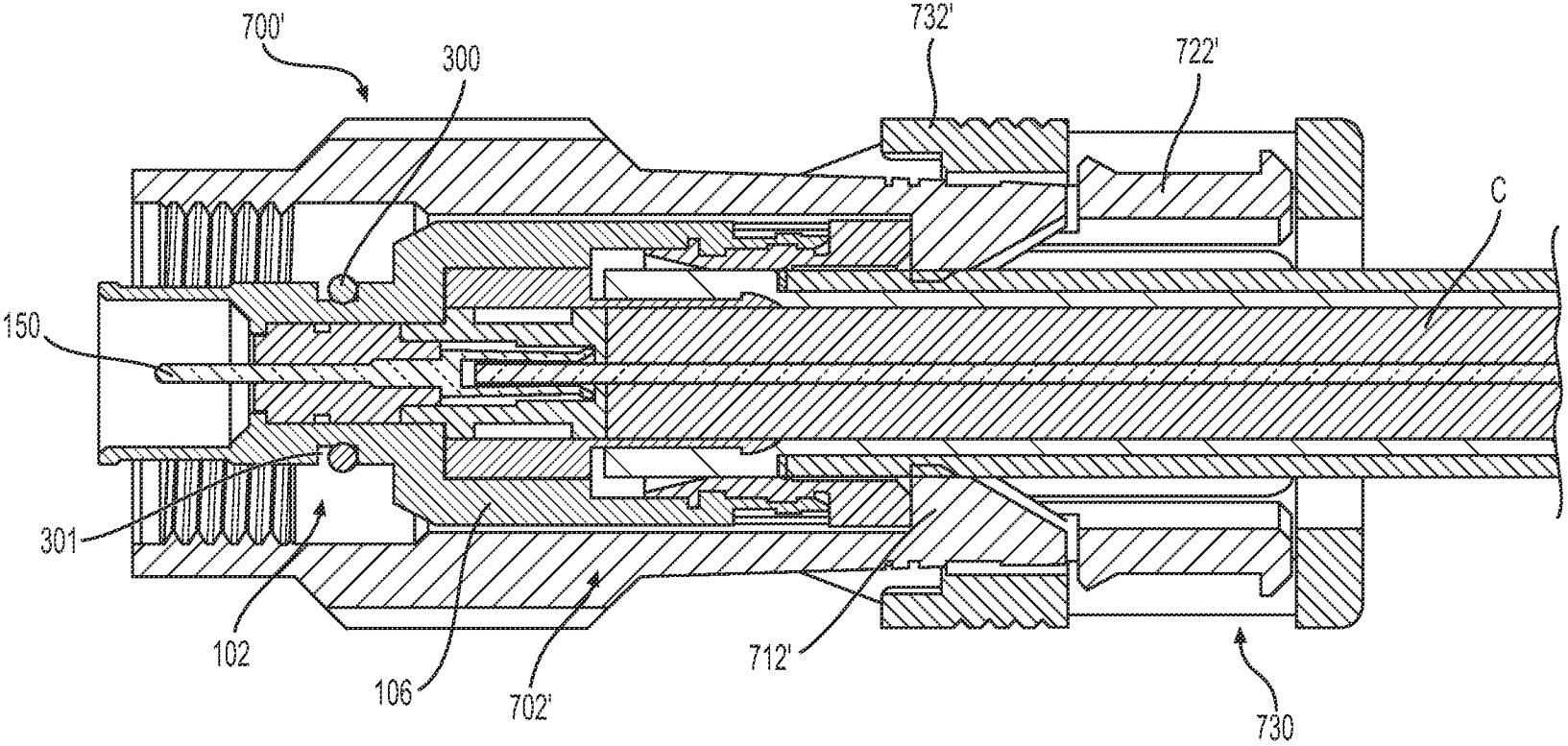
FIG. 17*g* is a cross-sectional view of the electrical connector illustrated in FIGS. 17*e* and 17*f;*
Figure 17H:
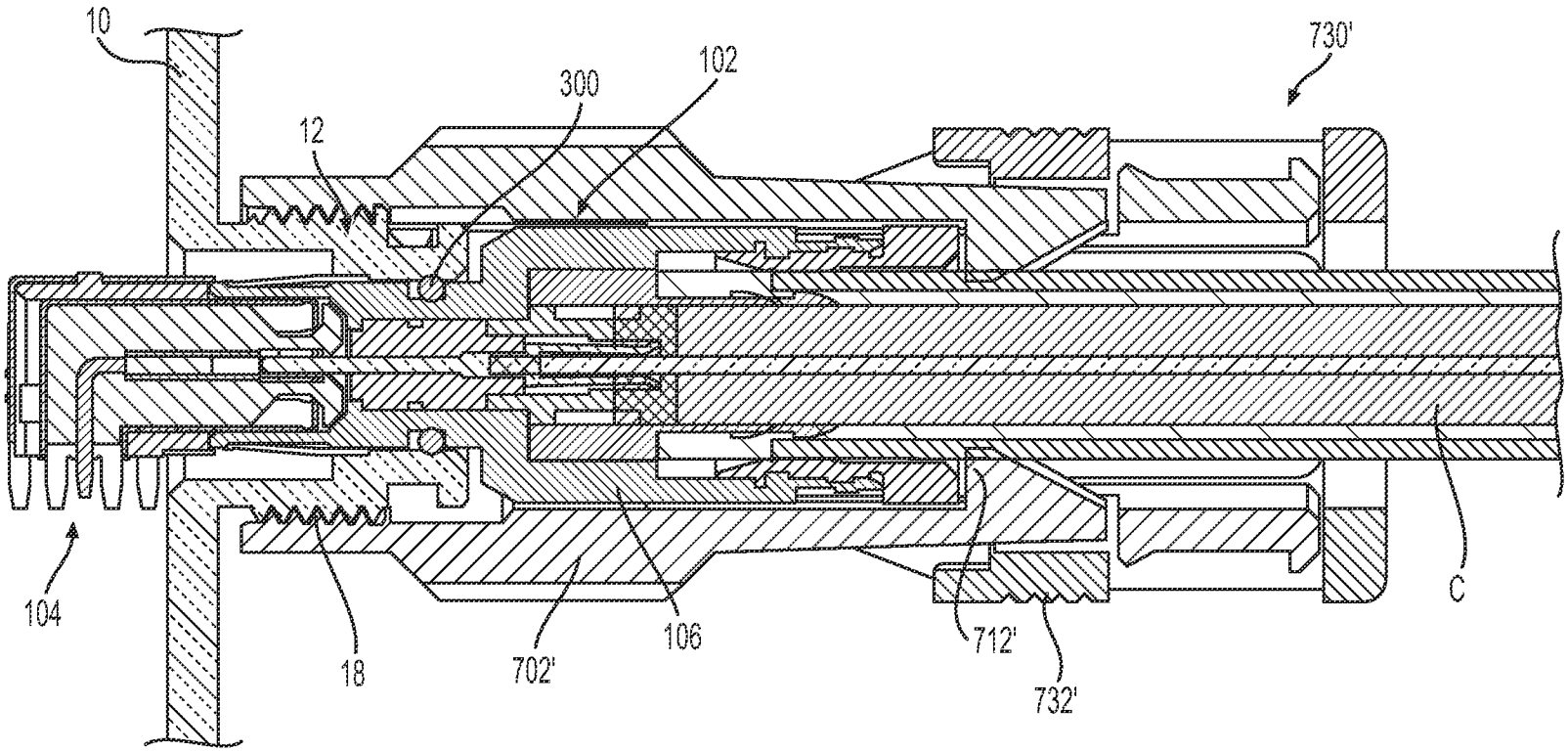
FIG. 17*h* is a cross-sectional view of the electrical connector assembly illustrated in FIGS. 17*e* and 17F.

FIGS. 17*a* and 17*b* illustrate the plug 102 in an initial mating position with the receptacle 104 and the coupling member 700' of FIG. 16*a* in a disengaged position. FIGS. 17*c* and 17*d* illustrate the electrical connector assembly of FIGS. 17*a* and 17*b* with the coupling member 700' in an engaged position with the receptacle 104 and the retaining member 730' in an unlocked position. FIGS. 17*e* and 17*f* illustrate the electrical connector assembly of FIGS. 17*c* and 17*d*, showing the retaining member 730' in a locked position.

Referring to FIGS. 17*a*-17*f*, the coupling sleeve 702' may be configured to slide over the plug 102 to convert the plug 102 from an indoor-use version to an outdoor-use version. In some examples, the plug 102 is converted from an indoor-use version to an outdoor-use version with the addition of a sealing member 300 on the plug's conductive shell 106. In some examples, a field technician may install the sealing member 300 onto the plug's conductive shell 106 at a groove 301 on the plug's conductive shell 106. The sealing member 300 provides a sealing function between the plug's conductive shell 106 and the inner bore 14 of the body 12 of the support 10 when the plug 102 is coupled to the receptacle 104. In addition, prior to coupling the plug 102 and the receptacle 104, the field technician may also install the coupling sleeve 702' for additional weather proofing and to strengthen the engagement between the plug 102 and the receptacle 104. The field technician may slide the coupling sleeve 702' over the plug 102 and onto the cable C, as shown in FIG. 17*d*. The coupling sleeve 702' can then be slid in the axial direction A to rotatably, and in some cases removably, secure the coupling sleeve 702' to the plug 102. The coupling sleeve 702' can then be secured to the annular groove 18, as shown in FIG. 17*f*, for example. Thus, the same plug 102 can be used for indoor applications as well as outdoor applications with the addition of the sealing member 300 and/or the coupling sleeve 702'. In practice, a field technician can carry these parts (for example, the plug 102, the sealing member 300, and the coupling sleeve 702') to a job site and decide whether to use the plug 102 by itself (as an indoor-use version) or to use the plug 102, the sealing member 300, and/or the coupling member 700' (as an outdoor-use version) as needed. This eliminates the need for a field technician to carry both indoor-only versions of the plug and outdoor-only versions of the plug, thereby maximizing flexibility and minimizing connector variants in inventory.

The retaining member 730' includes a ring body 732' where the ring body 732' has an extension 734', as seen in FIGS. 16*a* and 16*b*. An end portion 738' of the ring body 732' may include a protective shoulder that extends beyond the back of the coupling sleeve 702', as seen in FIG. 16*b*, and has an end face 739' facing outwardly and in a plane generally perpendicular to the longitudinal axis of the coupling sleeve 702'. The extension 734' of the ring body 732' may include one or more windows 736' sized to accept and reveal a flexible tine 722' at the back of the coupling sleeve 702', when the retaining member 730 is in the locked position with respect to the coupling sleeve 702', as seen in FIGS. 17*c* and 17*e*. The end portion 738' abuts or nearly abuts the end of the tine 722'. Similar to the tines 722 of the above example, each tine 722' of this example includes a ramp 724' which allows ring body '732 to slide forward and drop down behind the ramp 724', as described above, such that the retaining member 730' is in a locked position, as seen in FIGS. 16*a* and 16*b*. A "locked" notice can be put on one or more of the tines 722'.

Figure 18:
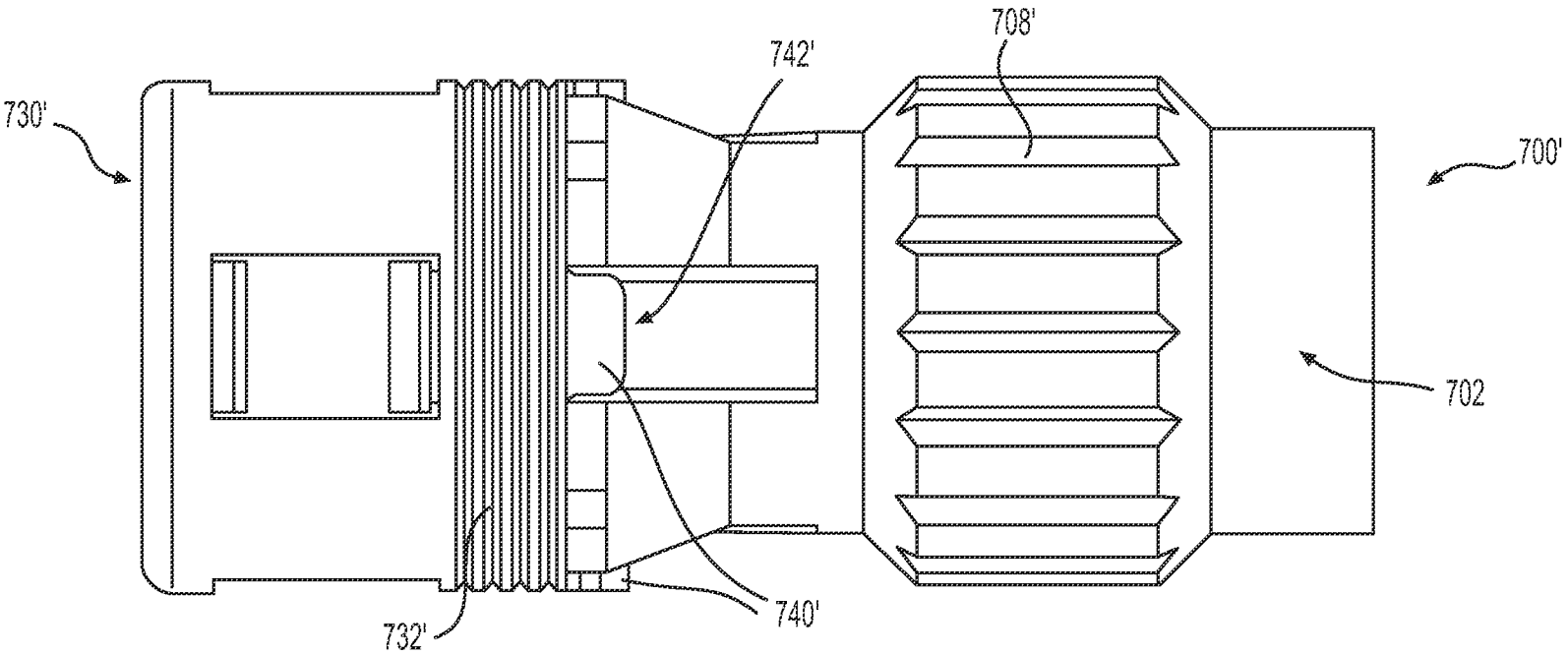
FIG. 18 is an elevational view of another coupling member and another retaining member according to yet another example of the present disclosure.

In an example, the ring body 732' of the retaining member 730' may include one or more tabs 740' projecting toward the front section of the coupling sleeve 702', as seen FIG. 18. Each tab 740' is designed to cooperate with a corresponding notch 742' on the outer surface of the coupling sleeve 702'. With the tabs 740' engaged in their respective notches 742', the user or installer can use the retaining member 730' to turn the whole assembly. Alternatively, without the tabs 740', the retaining member 730' can spin freely on the coupling sleeve 702'. An outer gripping surface 708' may include longitudinal grooves or knurls to assist with gripping of the sleeve 702'.

Figure 19A:
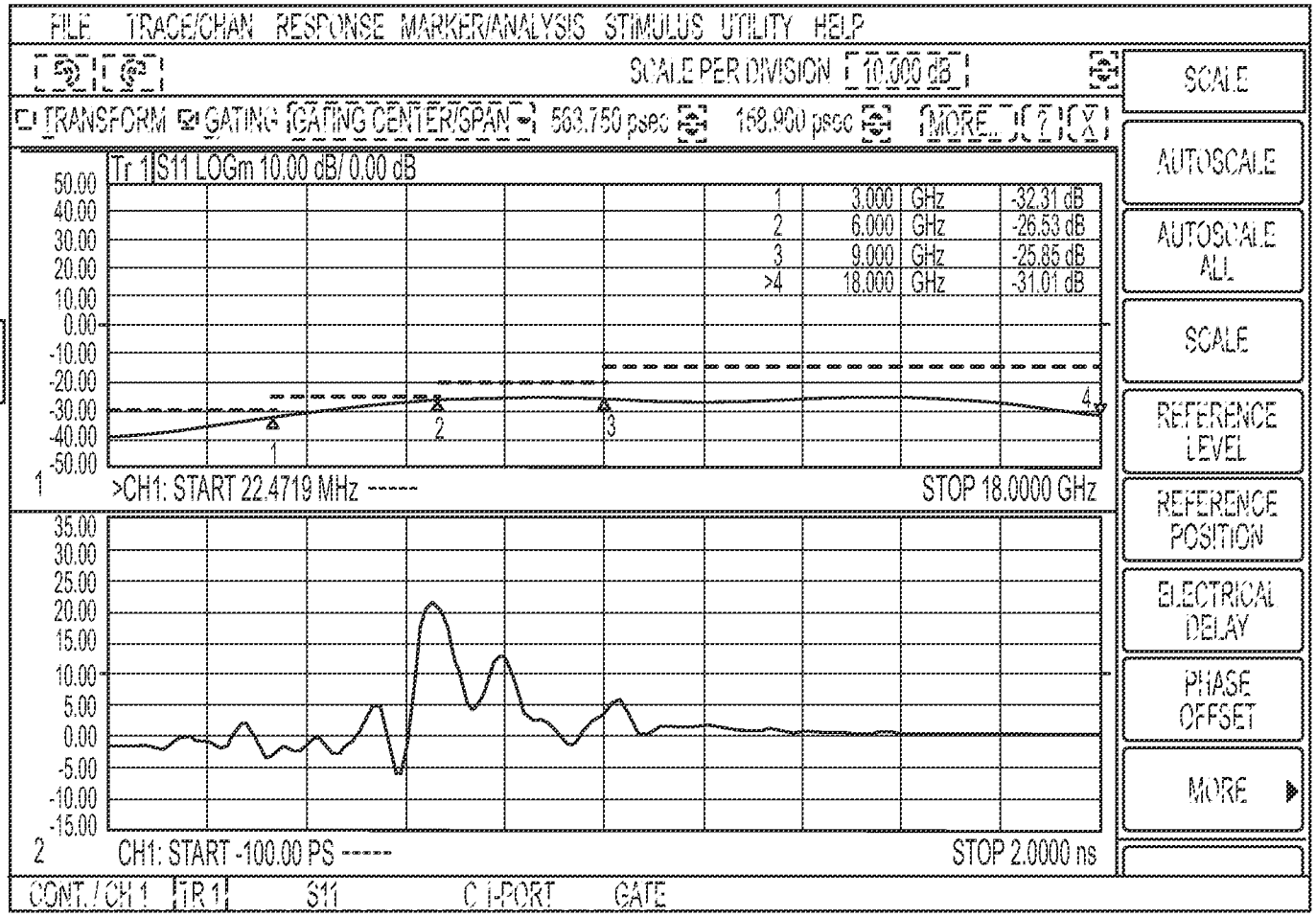
FIGS. 19*a* and 19*b* are charts showing the improved electrical performance of the electrical connector assembly of the present disclosure.
Figure 19B:
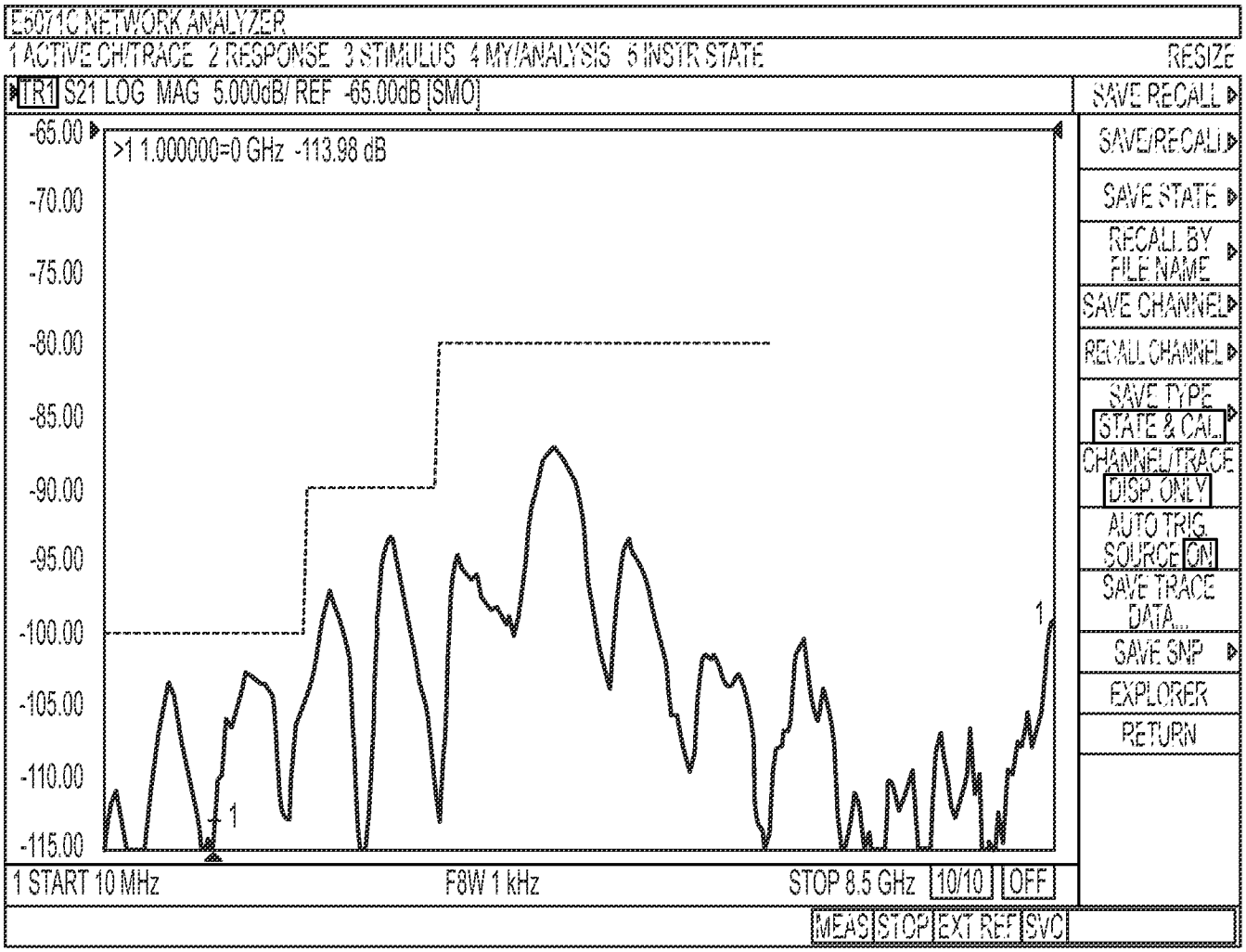

FIGS. 19*a* and 19*b* show charts of the electrical performance of the assembly 100 of the embodiments of the present disclosure. The data described in connection with FIGS. 19*a* and 19*b* may apply to either the indoor or outdoor connector assemblies of the present disclosure, that is with or without components, such as the coupling member.

The chart of FIG. 19*a* shows the Return Loss which is the reflected RF loss through the connector interface of the assembly 100 of the present disclosure. Return Loss is the most impactful parameter when evaluating the loss in an RF connector. The goal with any RF interconnect is to introduce minimal loss to the system. The total loss of a transmission line in a system is Insertion Loss, which is made up of many loss parameters added up over the length of the line. Return Loss is one component and is joined by conductivity losses, dielectric losses, leakage losses. For a relatively short length of a signal transmission, such as a connector interface like the present disclosure, the parameter that is most controllable to minimize is Return Loss. The chart of FIG. 19*a* shows the Return Loss performance against the industry specification (which is the table that is provided next to the chart of FIG. 19*a* defining a minimum performance within a certain frequency range) to meet current and future system requirements. FIG. 19*a* shows return loss performance of the connector against an example specification showing levels that may be required by the telecommunications industry for the transmission of high data rates of at least 12 Gbps. The specification is a stepped range specification (that is the specification is different for each frequency and increases in steps as opposed to a constant fixed specification over the full range or a linear but increasing at a given slope) which is common because Return Loss is inherently higher at higher frequencies. The frequency limit of 18 GHz of the present disclosure enables high data rates currently used in related markets, such as Broadcast. This market has the need, for example, to transmit 4K uncompressed video feeds which require 12 Gbps data speeds, which is enabled by the 18 GHz.

The chart of FIG. 19*b* shows RF Leakage, that is the amount of RF that leaks out of the mated interface of the assembly 100 of the present disclosure while a signal is transmitted. As seen in the chart of FIG. 19*b*, the configuration of the assembly 100 minimizes any RF leakage to prevent RF noise from interfering with other systems (such as other shared commercial bands such as Mobile Wireless Networks, WiFi, Bluetooth, and GPS). The inverse of RF leakage is RF ingress. For the CATV market, RF ingress is more critical than leakage as the operators needs to keep RF noise from the airwaves from interfering with their system. RF leakage is easier to measure than RF ingress and the test results are equivalent when considering the end goal of ingress protection. Again this specification, that is the table that is provided next to the chart of FIG. 19*b*, which defines a minimum performance within a certain frequency range, is set to meet current and future system needs. The specification is stepped because RF leakage is inherently higher at higher frequencies. The product is specified to 6 GHz to cover the majority of potentially conflicting RF wireless bands from 3, 4 and 5G Mobile Wireless Networks as well as other common commercial technologies such as WiFi, Bluetooth, and GPS.

In the embodiments of the present disclosure, the connectors may be round/tubular connectors and the ground features can be non-round shapes, such as square and still take advantage of the dual grounding shielding benefits. The secondary ground connection can be a directly integrated metal conductive component or positioned as an independent shield component isolated from the primary ground by a dielectric material, such as air or plastic.

The electrical connectors and assembly thereof of the present disclosure may (1) incorporate a push-on interface which simplifies mating to eliminate or reduce connectivity issues during self-installation applications; (2) provide higher density packaging potential by removing wrench clearance needs between connectors; (3) incorporate a pinned interface, i.e. there is a dedicated center contact or signal pin in the interface of the plug side of the connector eliminating the need to feed the cable center conductor through to the interface to become the center contact of the plug, for consistent RF impedance and therefore performance headroom for higher frequencies (up to 18 GHz) and for high reliability contact integrity and dependable extended field life; and/or (4) provide a robust scoop-proof interface configured such that when a mating connector is partially mated and then angled in any non-coaxial position, it is not possible to "scoop" with the mating interface and make contact with or damage any internal components thereof, such as the outer contact, insulator, or center contact. The scoop-proof configuration may be achieved, for example, by recessing the contact members in the outer ground/shroud.

The electrical connectors and assembly thereof of the present disclosure may also have a configuration that allows for full sheet metal construction for long term cost benefit such as by eliminating the need to manufacture threads; provides standard compression crimp termination and existing tools; and/or leverages field proven interface technology from latest generation CMTS routers, such as blind mate connections between printed circuit boards to achieve robust mechanical and electrical performance for the connector system.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as front back, elongated, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A connector, comprising:

a conductive shell supporting at least one signal contact therein and comprising a front end for mating with a mating connector and a back end opposite the front end for connecting to a power or data transmission cable;

a coupling member configured to engage the conductive shell and engage a corresponding component associated with the mating connector to mechanically couple the connector to the mating connector, a back section of the coupling member including one or more flexible protection tines adjacent to one or more flexible snap latches;

a retaining ring disposed on the back section of the coupling member that is slidable with respect to the coupling member between unlocked and locked positions, and the retaining ring includes one or more windows corresponding to the one or more flexible protection tines of the coupling member; and a plurality of ground connections provided at the front end of the conductive shell and the front section of the coupling member that are configured to connect the mating connector with the connector and the cable.

2. The connector of claim 1, wherein the coupling member is disposed on the conductive shell.

3. The connector of claim 2, wherein the coupling member is rotatably coupled to the conductive shell.

4. The connector of claim 1, wherein the retaining member comprises a ring body disposed on the coupling sleeve.

5. The connector of claim 4, wherein the ring body includes an end portion that extends beyond the back section of the coupling member.

6. The connector of claim 1, wherein the front section of the coupling member includes inner threads.

7. The connector of claim 1, wherein the plurality of ground connections define a plurality of grounding paths through the connector to electrically engage the mating connector with the connector and the cable.

8. The connector of claim 1, wherein the coupling member is a spring clip that engages an outer annular groove of the conductive shell.

9. The connector of claim 1, wherein the conductive shell includes a dielectric insert that supports the at least one signal contact.

10. The connector of claim 1, wherein the connector is an electrical connector.

11. A connector, comprising:

a conductive shell supporting at least one signal contact therein and comprising a front end for mating with a mating connector, a back end opposite the front end for connecting to a power or data transmission cable;

a coupling sleeve disposed on the conductive shell, the coupling sleeve including a front section configured to engage a corresponding component associated with the mating connector, and a back section configured to engage the conductive shell, the coupling sleeve comprises an elongated body with an outer gripping surface, the front section of the coupling sleeve includes inner threads, and the back section is configured to cover the back end of the conductive shell, wherein the coupling sleeve includes one or more flexible latches for engaging the conductive shell and one or more flexible protection tines adjacent to the one or more flexible latches; and a retaining member disposed on at least a portion of the coupling sleeve that is slidable with respect to the coupling sleeve between unlocked and locked positions, the retaining member comprises a ring body disposed over the one or more flexible protection tines, and wherein the ring body includes one or more windows that correspond to the one or more flexible protection tines of the back section of the coupling sleeve.

12. The connector of claim 11, wherein the ring body is configured to slide axially with respect to the back end of the conductive shell between the unlocked and locked positions.

13. The connector of claim 11, wherein the ring body includes an end portion that extends beyond the back section of the coupling sleeve, the end portion includes an end face in a plane generally perpendicular to a longitudinal axis of the coupling sleeve.

14. The connector of claim 13, wherein the ring body includes one or more tabs opposite the end face that are configured to engage corresponding notches on an outer surface of the coupling sleeve.

15. The connector of claim 11, further comprising a plurality of ground connections that define a plurality of grounding paths.

16. The connector of claim 11, wherein the connector is an electrical connector.

17. A connector, comprising:

a conductive shell supporting at least one signal contact therein and comprising a front end for mating with a mating connector, a back end opposite the front end for electrically connecting to a power or data transmission cable, and the front end including a primary ground connection configured to electrically connect the mating connector with the cable;

a coupling sleeve disposed on the conductive shell, the coupling sleeve including a front section having inner threads configured to engage a corresponding component associated with the mating connector, and a back section having one or more flexible snap latches configured to engage the back end of the conductive shell, and the back section including one or more flexible protection tines adjacent to the one or more flexible snap latches, and the front section of the coupling sleeve including a secondary ground connection configured to electrically connect the mating connector with the cable; and a retaining ring disposed on the back section of the coupling sleeve that is slidable with respect to the coupling sleeve between unlocked and locked positions, and the retaining ring includes one or more windows corresponding to the one or more flexible protection tines of the coupling sleeve.

18. The connector of claim 17, wherein each flexible protection tine includes a ramped surface configured to facilitate sliding of the retaining ring to the locked position.

19. The connector of claim 17, wherein the corresponding component of the mating connector is an engagement feature of a support panel or wall in which the mating connector is mounted.

20. The connector of claim 17, wherein the primary and secondary ground connections are separate contact points, at least one of the contact points being on an outer surface of the front end of the conductive shell and another of the contact points being on an inner surface of the front section of the coupling member.

21. The connector of claim 17, wherein the primary and secondary ground connections define a plurality of grounding paths, and the plurality of grounding paths combine to form a combined ground path within the electrical connector.

22. The connector of claim 17, wherein the primary and secondary ground connections define a plurality of grounding paths, and the plurality of ground paths combine to form a combined ground path outside of the electrical connector.

23. The connector of claim 17, wherein the connector is an electrical connector.

* * * * *